US010759179B2

(12) United States Patent
Koganehira et al.

(10) Patent No.: US 10,759,179 B2
(45) Date of Patent: Sep. 1, 2020

(54) SUB-TANK AND CONSUMABLE ARTICLE CONSUMPTION SYSTEM

(71) Applicant: SEIKO EPSON CORPORATION, Tokyo (JP)

(72) Inventors: Shuichi Koganehira, Matsumoto (JP); Shigeki Fukushima, Matsumoto (JP); Yasuhiko Kosugi, Matsumoto (JP); Takahiro Imai, Shimosuwa (JP); Katsutoshi Ozawa, Azumino (JP); Tsuyoshi Hayashi, Shiojiri (JP); Noriyuki Inukai, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/157,268

(22) Filed: Oct. 11, 2018

(65) Prior Publication Data

US 2019/0111697 A1 Apr. 18, 2019

(30) Foreign Application Priority Data

Oct. 13, 2017 (JP) ..... 2017-199113

(51) Int. Cl.
*B41J 2/175* (2006.01)

(52) U.S. Cl.
CPC ..... *B41J 2/17566* (2013.01); *B41J 2/175* (2013.01); *B41J 2/1753* (2013.01); *B41J 2/17506* (2013.01); *B41J 2/17509* (2013.01); *B41J 2/17513* (2013.01); *B41J 2/17546* (2013.01); *B41J 2002/17516* (2013.01)

(58) Field of Classification Search
CPC .. B41J 2/17566; B41J 2/1753; B41J 2/17546; B41J 2002/17569; B41J 2/175; B41J 2/17509; B41J 29/38; B41J 2002/17516; B41J 2/17506; B41J 2/17513
See application file for complete search history.

(56) References Cited

U.S. PATENT DOCUMENTS

2014/0063089 A1* 3/2014 Kosugi ..... B41J 2/17509 347/7
2017/0001445 A1 1/2017 Matsumoto

FOREIGN PATENT DOCUMENTS

| | | | |
|---|---|---|---|
| JP | 2013-123810 | A | 6/2013 |
| JP | 2014-205301 | A | 10/2014 |
| JP | 2017-013045 | A | 1/2017 |
| JP | 2017-072737 | A | 4/2017 |

* cited by examiner

*Primary Examiner* — Jannelle M Lebron
(74) *Attorney, Agent, or Firm* — Oliff PLC

(57) ABSTRACT

Provided is a technique that can reduce at least one of various inconveniences in a sub-tank, such as stock management being complicated. The sub-tank includes: a consumable article containing portion; a sub-tank-side storage unit; and a case that can be detachably attached to multiple slots in a consumable article consumption apparatus and contains the consumable article containing portion. In a state before the sub-tank is first mounted in the slot, the sub-tank-side storage unit stores a sub-tank-side identifier configured to distinguish from another sub-tank, and in a state after the sub-tank is first mounted in the slot, the sub-tank-side storage unit further stores sub-tank-side consumable article information relating to an attribute of the consumable article replenished in a consumable article containing portion.

10 Claims, 13 Drawing Sheets

332

| SLOT IDENTIFIER REGION | MAIN BODY-SIDE CONSUMABLE ARTICLE INFORMATION REGION ( COLOR ATTRIBUTE ) | MAIN BODY-SIDE IDENTIFIER REGION |
|---|---|---|
| SC1a | CYAN | TA11 |
| SC2a | CYAN | TA12 |
| SM1a | MAGENTA | TA13 |
| SM2a | MAGENTA | TA14 |
| SY1a | YELLOW | TA15 |
| SY2a | YELLOW | TA16 |
| SK1a | BLACK | TA17 |
| SK2a | BLACK | TA18 |

FIG. 4

334

| SLOT IDENTIFIER REGION | SUB-TANK-RELATED INFORMATION | | | | |
|---|---|---|---|---|---|
| | REPLENISHMENT AMOUNT REGION | CONSUMPTION AMOUNT REGION | CONSUMABLE ARTICLE REMAINING AMOUNT REGION | PRESSURE INCREASE INSTANCE COUNT REGION | PRESSURE REDUCTION INSTANCE COUNT REGION |
| SC1a | 900ml | 100ml | 800ml | 1 INSTANCE | 1 INSTANCE |
| SC2a | 300ml | 0ml | 300ml | 5 INSTANCES | 5 INSTANCES |
| SM1a | 800ml | 300ml | 500ml | 20 INSTANCES | 20 INSTANCES |
| SM2a | 500ml | 400ml | 100ml | 19 INSTANCES | 19 INSTANCES |
| SY1a | 900ml | 100ml | 800ml | 1 INSTANCE | 1 INSTANCE |
| SY2a | 400ml | 0ml | 400ml | 2 INSTANCES | 2 INSTANCES |
| SK1a | 900ml | 150ml | 750ml | 1 INSTANCE | 1 INSTANCE |
| SK2a | 300ml | 200ml | 100ml | 30 INSTANCES | 30 INSTANCES |

FIG. 5

| | | REPLENISHMENT AMOUNT OF PREVIOUS INSTANCE | | |
|---|---|---|---|---|
| | | LESS THAN 300 ml | 300 ml OR MORE, LESS THAN 600 ml | 600 ml OR MORE |
| AMOUNT OF TIME ELAPSED SINCE PREVIOUS INSTANCE OF REPLENISHMENT PROCESSING | LESS THAN 3 WEEKS | DO NOT GIVE INSTRUCTION | DO NOT GIVE INSTRUCTION | DO NOT GIVE INSTRUCTION |
| | 3 WEEKS OR MORE, LESS THAN 6 WEEKS | GIVE INSTRUCTION | GIVE INSTRUCTION | DO NOT GIVE INSTRUCTION |
| | 6 WEEKS OR MORE | GIVE INSTRUCTION | GIVE INSTRUCTION | GIVE INSTRUCTION |

FIG.14

SUB-TANK AND CONSUMABLE ARTICLE CONSUMPTION SYSTEM

BACKGROUND

1. Technical Field

The present invention relates to a technique for a sub-tank for containing a consumable article.

2. Related Art

Conventionally, a technique has been known in which ink is replenished in a sub-tank from an ink cartridge and ink is supplied from the sub-tank to an inkjet head (e.g., JP A-2014-205301).

JP A-2014-205301 is an example of related art.

In the technique of replenishing ink in the sub-tank from an ink cartridge, if the sub-tanks mounted in the slots of the inkjet recording apparatus are not interchangeable, sub-tanks of multiple types are handled, and the following inconveniences occur. For example, the manufacturing cost of the sub-tanks increases, stock management of the sub-tanks becomes complicated, and handling of the sub-tanks becomes complicated in some cases. Accordingly, a technique has been desired which can reduce at least one of the above-described inconveniences.

Also, the above-described problems are not limited to an inkjet recording apparatus and a sub-tank to be used in an inkjet recording apparatus, and is the same for a sub-tank to be used in a consumable article consumption apparatus that discharges a consumable article, and for a consumable article consumption system including a sub-tank and a consumable article consumption apparatus.

SUMMARY

The invention has been made to solve at least a part of the above-mentioned problems, and can be realized as the following modes or application examples.

(1) According to an aspect of the invention, a sub-tank for supplying a consumable article to a consumable article consumption apparatus is provided. This sub-tank includes: a consumable article containing portion configured to contain the consumable article due to the sub-tank being mounted in a slot of the consumable article consumption apparatus and the consumable article being replenished from a main tank containing the consumable article; a sub-tank-side storage unit; and a case that can be detachably attached to a plurality of slots of the consumable article consumption apparatus, the case containing the consumable article containing portion. The sub-tank-side storage unit stores a sub-tank-side identifier configured to distinguish from another sub-tank in a state before first being mounted in the slot, and further stores sub-tank-side consumable article information relating to an attribute of the consumable article replenished in the consumable article containing portion in a state after first being mounted in the slot.

According to this aspect, the sub-tank includes a case that can be detachably attached to multiple slots, and if the consumable article is replenished from the main tank, the sub-tank-side storage unit stores the sub-tank-side consumable article information. Accordingly, in a state before first being mounted in a slot, the sub-tank can be used in common for multiple slots, and therefore there is no need to manage stocks of sub-tanks for each slot. Also, according to this aspect, the sub-tank-side storage unit stores the sub-tank-side identifier, and therefore after the consumable article is replenished in the consumable article containing portion, it is possible to easily distinguish between the sub-tank and another sub-tank.

(2) In the above-described mode, if the sub-tank-side storage unit further stores the sub-tank-side consumable article information, when the sub-tank is mounted in the slot of another consumable article consumption apparatus that is different from the consumable article consumption apparatus in which the sub-tank was first mounted, the sub-tank-side storage unit may store information configured to identify being mounted in the slot of the other consumable article consumption apparatus. According to this mode, using the data for identification, it is possible to determine whether or not the sub-tank was mounted in a slot of another consumable article consumption apparatus.

(3) According to another aspect of the invention, a consumable article consumption system is provided. This consumable article consumption system includes: a consumable article consumption apparatus having a discharge portion for discharging a consumable article, a plurality of slots, and a controller; a sub-tank having a case that can be detachably attached to the plurality of slots; and a main tank for containing the consumable article to be replenished in the sub-tank mounted in the slot. The consumable article consumption apparatus further includes a main body-side storage unit for storing main body-side consumable article information relating to an attribute of the consumable article associated with each of the plurality of slots. The sub-tank further includes: a consumable article containing portion that is contained in the case and is configured to contain the consumable article to be supplied to the discharge portion due to the consumable article being replenished from a main tank containing the consumable article; and a sub-tank-side storage unit. When the sub-tank is first mounted in one of the plurality of slots, the controller stores the main body-side consumable article information associated with the slot in which the sub-tank is mounted, in the sub-tank-side storage unit as sub-tank-side consumable article information.

According to this aspect, the sub-tank includes a case that can be detachably attached to multiple slots, and when the sub-tank is first mounted in a slot, the sub-tank-side storage unit stores the sub-tank-side consumable article information. Accordingly, in a state before first being mounted on a slot, the sub-tank can be used in common for multiple slots, and therefore there is no need to manage stocks of sub-tanks for each slot.

(4) In the above-described mode, the sub-tank-side storage unit may store a sub-tank-side identifier configured to distinguish from another sub-tank. According to this mode, it is possible to easily distinguish between the sub-tank and the other sub-tank using the sub-tank-side identifier.

(5) In the above-described mode, when the sub-tank is first mounted in the slot, the controller may read out the sub-tank-side identifier from the sub-tank-side storage unit and store the sub-tank-side identifier in association with the slot that is the mounting destination as a main body-side identifier in the main body-side storage unit. According to this mode, by comparing the main-body-side identifier and the sub-tank-side identifier, the controller can easily determine whether or not the sub-tank has been mounted in the slot in the past.

(6) In the above-described mode, when the sub-tank with the sub-tank-side storage unit in which the sub-tank-side consumable article information is stored is mounted in the slot, if (i) the main body-side identifier associated with the slot that is the mounting destination and the sub-tank-side identifier stored in the sub-tank-side storage unit are different and (ii) the sub-tank-side identifier is different from all of a plurality of the main body-side identifiers associated with each of the plurality of slots, the controller may store, in the sub-tank-side storage unit, identification information configured to identify that the sub-tank was mounted in the slot of another consumable article consumption apparatus. According to this mode, it is possible to easily determine that the sub-tank was mounted in a slot of another consumable article consumption apparatus.

(7) In the above-described mode, when the sub-tank is mounted in the slot, if the identification information is stored in the sub-tank-side storage unit of the mounted sub-tank, the controller may replenish the consumable article in the mounted sub-tank from the main tank. According to this mode, the consumable article can be replenished in the sub-tank before the consumable article in the sub-tank is consumed. Accordingly, it is possible to reduce the likelihood that the consumable article in the sub-tank will run out.

(8) In the above-described mode, the controller may stop the supply of the consumable article to the discharge portion before the supply amount of the consumable article supplied to the discharge portion becomes greater than or equal to the replenishment amount of the consumable article in the sub-tank with the sub-tank-side storage unit in which the identification information is stored. According to this mode, it is possible to reduce the likelihood that the consumable article in the sub-tank will run out.

(9) In the above-described mode, the identification information may be indicated by a flag. According to this mode, it is possible to easily determine whether or not the sub-tank was mounted in a slot of another consumable article consumption apparatus by using a flag.

(10) In the above-described mode, if the consumable article is to be replenished in the sub-tank mounted in the slot from the main tank, the controller may set the interior of the case to a predetermined pressure reduction state. If the consumable article is to be supplied to the discharge portion from the sub-tank mounted in the slot, the controller may set the interior of the case to a predetermined pressure increase state. The controller may store the number of instances of the pressure reduction state and the number of instances of the pressure increase state in the main body-side storage unit in association with the slot, and each time the interior of the case is set to the pressure reduction state and the pressure increase state, the controller may add 1 to each of the number of instances of the pressure reduction state and the number of instances of the pressure increase state in the sub-tank-side storage unit. When the sub-tank with the sub-tank-side storage unit in which the sub-tank-side consumable article information is stored is mounted in the slot, if at least one of a first mismatch condition and a second mismatch condition is satisfied, the first mismatch condition being that the number of instances of the pressure reduction state stored in association with the slot and the number of instances of the pressure reduction state stored in the sub-tank-side storage unit do not match and the second mismatch condition being that the number of instances of the pressure increase state stored in association with the slot and the number of instances of the pressure increase state stored in the sub-tank-side storage unit do not match, the controller may replenish the consumable article in the mounted sub-tank from the main tank. According to this mode, the consumable article can be replenished in the sub-tank before the consumable article in the sub-tank is consumed. Accordingly, it is possible to reduce the likelihood that the consumable article in the sub-tank will run out.

(11) In the above-described mode, if at least one of the first mismatch condition and the second mismatch condition is satisfied, the controller may stop supply of the consumable article to the discharge portion before the supply amount of the consumable article supplied to the discharge portion becomes greater than or equal to the replenishment amount of the consumable article in the sub-tank in which the consumable article was replenished. According to this mode, it is possible to reduce the likelihood that the consumable article in the sub-tank will run out.

(12) In the above-described mode, the main body-side storage unit may further store sub-tank-related information including consumable article remaining amount information of the sub-tank, associated with each of the plurality of slots. When the sub-tank with the sub-tank-side storage unit in which the sub-tank-side consumable article information is stored is mounted in the slot, if (i) the main body-side identifier associated with the slot that is the mounting destination and the sub-tank-side identifier stored in the sub-tank-side storage unit are different and (ii) the sub-tank is mounted in another slot associated with the main body-side consumable article information that is the same as the sub-tank-side consumable article information among the plurality of slots included in the same consumable article consumption apparatus, the controller may re-writes the main body-side identifier associated with the slot that is the mounting destination to the sub-tank-side identifier of the mounted sub-tank, and re-write the sub-tank-related information associated with the slot that is the mounting destination according to the re-writing of the sub-tank-side identifier of the mounted sub-tank. According to this mode, it is possible to reduce the likelihood that the handling of the sub-tank will become complicated for the user.

Note that the invention can be implemented in various forms other than a sub-tank and a consumable article consumption system, such as a method for controlling a consumable article consumption system, a computer program for controlling a consumable article consumption system, or a storage medium storing the computer program.

BRIEF DESCRIPTION OF THE DRAWINGS

The invention will be described with reference to the accompanying drawings, wherein like numbers reference like elements.

FIG. 4 is a diagram for illustrating an identifier table.

FIG. 5 is a diagram showing a replenishment table.

FIG. 14 is a diagram showing a condition for a stirring instruction that is executed by the operation controller and is notified to a user.

DESCRIPTION OF EXEMPLARY EMBODIMENTS

A. First Embodiment

Figure 1:
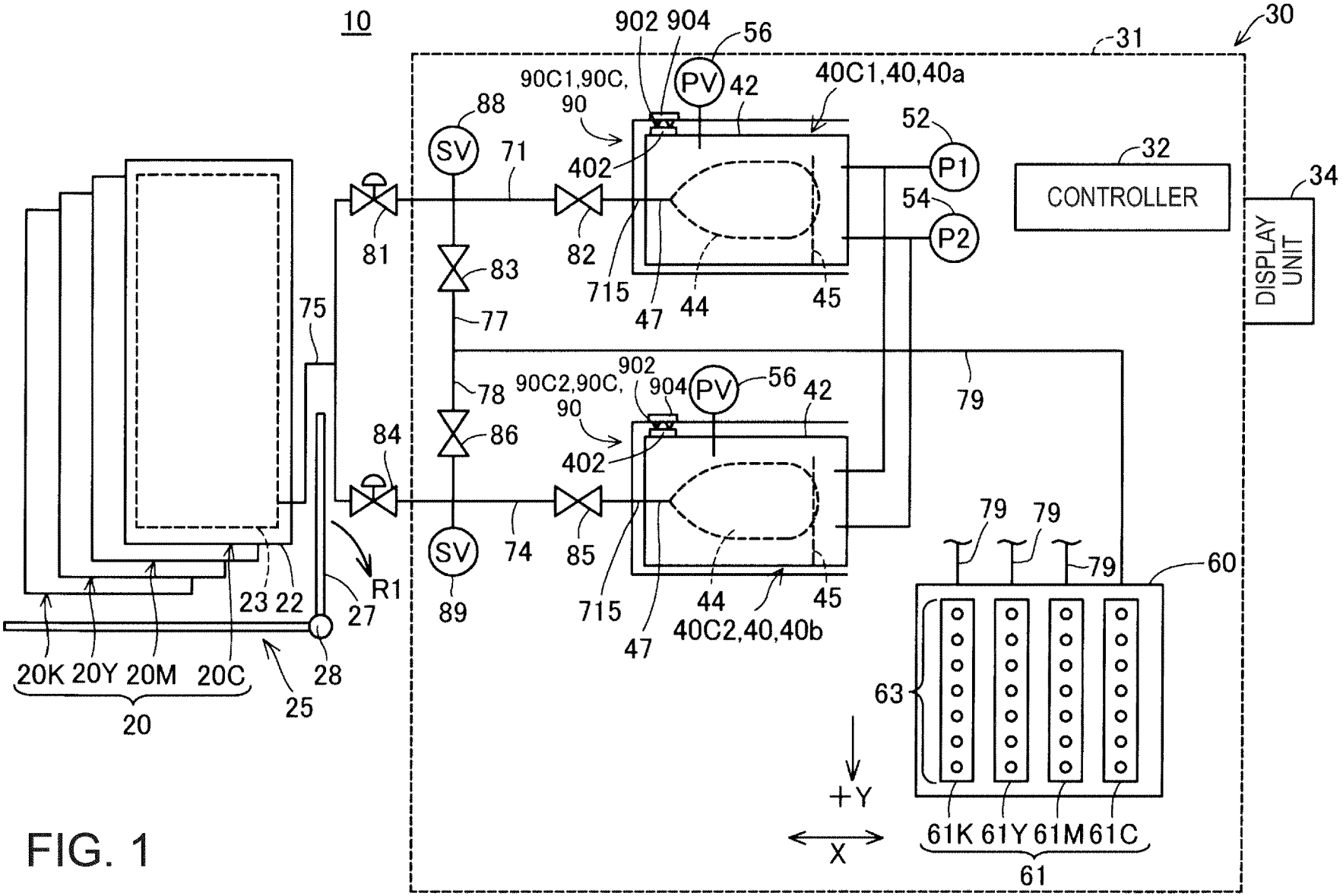
FIG. 1 is a schematic diagram of a consumable article consumption system serving as a first embodiment of the invention.
Figure 2:
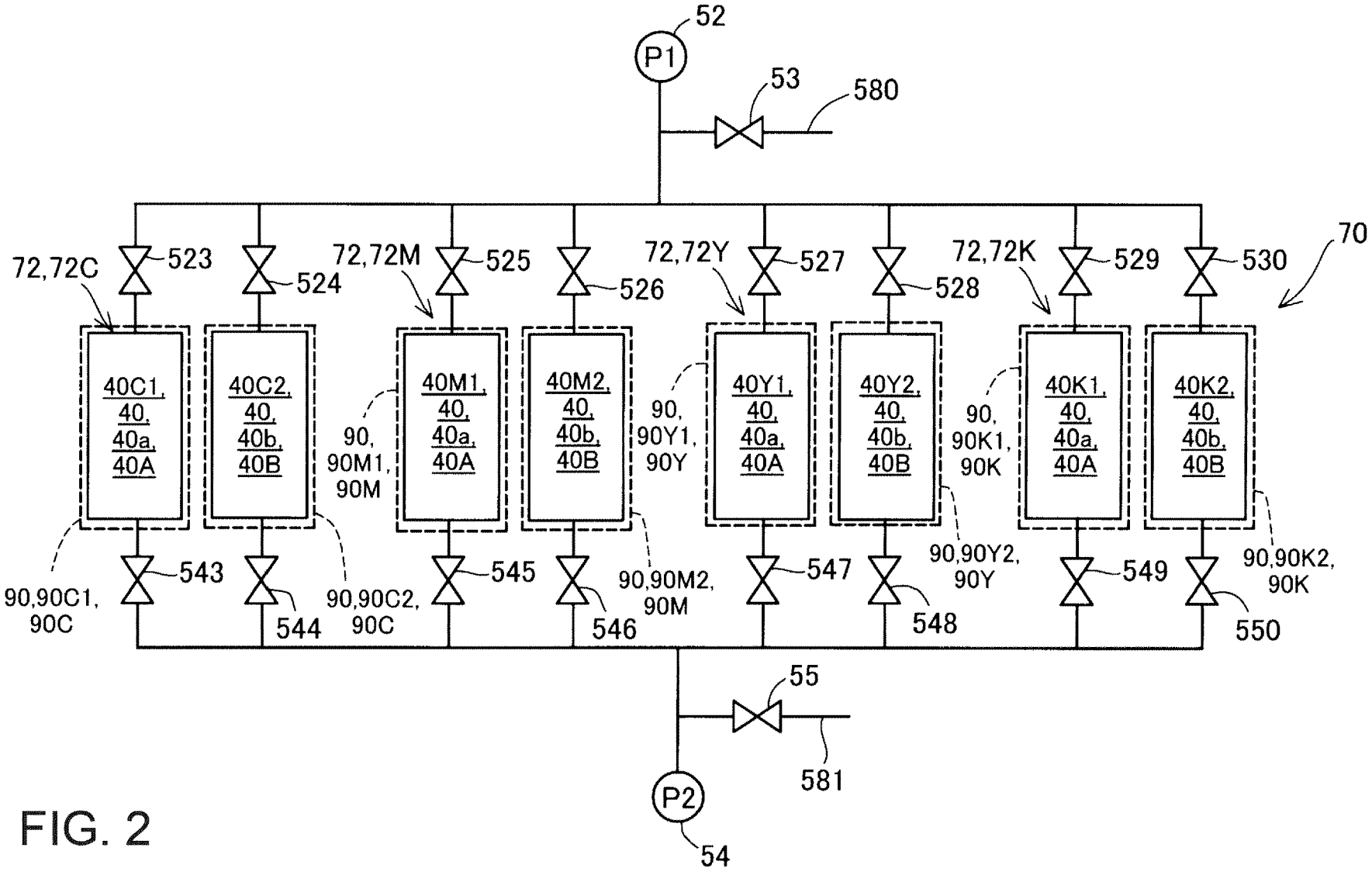
FIG. 2 is a diagram for illustrating a connection state of a sub-tank, a supply pump, and a replenishment pump.

A-1: Configuration of Consumable Article Consumption System:

FIG. 1 is a schematic diagram of a consumable article consumption system 10 serving as a first embodiment of the invention. FIG. 2 is a diagram for illustrating a connection state of sub-tanks, supply pumps, and replenishment pumps, and is a diagram showing control of air pressure in the sub-tanks. In FIG. 2, in order to facilitate comprehension, multiple slots 90 included in a consumable article consumption apparatus 30 are indicated schematically by broken lines.

The consumable article consumption system 10 (FIG. 1) includes main tanks 20, the consumable article consumption apparatus 30, and sub-tanks 40. The main tanks 20 are arranged outside of the housing of the consumable article consumption apparatus 30. The consumable article consumption apparatus 30 is an inkjet-type printer that performs recording (printing) by ejecting ink, which is an example of a consumable article, onto a medium such as a sheet.

The main tanks 20 can be replaced with new main tanks 20 by a user. The main tanks 20 contain ink serving as a consumable article to be replenished in the sub-tanks 40 mounted in the slots (sub-tank mounting portions) 90. If four main tanks 20 are used distinguished according to attributes (colors) of the consumable article contained therein, reference signs "20C", "20M", "20Y", and "20K" are used. In the present embodiment, yellow (Y), magenta (M), cyan (C), and black (K) inks are respectively contained in different main tanks 20C to 20K. The main tank 20C contains cyan ink. The main tank 20M contains magenta ink. The main tank 20Y contains yellow ink. The main tank 20K contains black ink. The main tanks 20 can contain larger amounts of the consumable article than the later-described sub-tanks 40. The consumable article stored in the main tanks 20 is ink that includes a precipitation component (pigment), for example. The main tanks 20 each include a container main body 22 and a main consumable article containing portion 23 that is contained in the container main body 22. The main consumable article containing portion 23 is a flexible bag with a volume that decreases as the consumable article is consumed.

One main tank 20 is provided for each later-described sub-tank set 72C to 72K (FIG. 2), and each main tank 20 is connected in parallel to multiple sub-tanks 40 that constitute the sub-tank sets 72C to 72K. The main tanks 20 contain the consumable article to be supplied to the sub-tanks 40.

The main tanks 20 (FIG. 1) are arranged in a tank arrangement portion 25. Specifically, the main tanks 20 are arranged on the bottom wall 26 of the tank arrangement portion 25. A consumable article supply portion of the main tank 20 is exposed to the outside by rotating a main tank lever 27 that rises upward from the bottom wall 26, in the direction of arrow R1 about a fulcrum 28. The consumable article supply portion of the main tank 20 is a portion for supplying the consumable article of the main consumable article containing portion 23 to a connection member of the later-described consumable article consumption apparatus 30. After performing opening by rotating the main tank lever 27 in the direction of the arrow R1, the user removes the connection member of the consumable article consumption apparatus 30 from the consumable article supply portion of the main tank 20. Then, the removed main tank 20 is lifted and removed from the tank arrangement portion 25, and thereafter a new main tank 20 is arranged on the bottom wall 26 of the tank arrangement portion 25. Then, the consumable article supply portion of the new main tank 20 and the connection portion of the consumable article consumption apparatus 30 are connected, and thereafter the main tank lever 27 is closed by being rotated in the direction opposite to the arrow R1. Accordingly, the user can replace a main tank 20 with a new main tank 20.

The sub-tanks 40 supply the consumable article to the consumable article consumption apparatus 30 (specifically, a later-described discharge portion 60). The sub-tanks 40 each include a case 42, a consumable article containing portion 44 contained in the case 42, a circuit board 402, and the like. Two sub-tanks 40 are provided for each of the main tanks 20C to 20K. That is, two sub-tanks 40 are provided for each attribute (in this embodiment, color) of the consumable article. The sub-tanks 40 can be detachably attached to the later-described slots 90 of the consumable article consumption apparatus 30. Also, the sub-tanks 40 can be detachably attached to the slots 90 of another consumable article consumption apparatus 30 with the same configuration (i.e., another consumable article consumption apparatus 30 of the same model). As described above, the sub-tanks 40 are interchangeable and thus can be attached to and detached from the multiple slots 90 in common. The details of the sub-tanks 40 will be described later.

In FIG. 1, among the multiple sub-tanks 40, two sub-tanks 40C1 and 40C2, in which the consumable article is replenished from the main tank 20C containing the cyan consumable article, are shown. Other than the two sub-tanks 40C1 and 40C2, as shown in FIG. 2, sub-tanks 40M1, 40M2, 40Y1, 40Y2, 40K1, and 40K2 are detachably mounted in the slots 90. The consumable article is replenished in the two sub-tanks 40M1 and 40M2 from the main tank 20M containing the magenta consumable article. The consumable article is replenished in the two sub-tanks 40Y1 and 40Y2 from the main tank 20Y containing the yellow consumable article. The consumable article is replenished in the two sub-tanks 40K1 and 40K2 from the main tank 20K containing the black consumable article. If the multiple sub-tanks 40C1 to 40K2 are used with no distinction made therebetween, "sub-tanks 40" is used. In the two sub-tanks 40 containing consumable articles of the same attribute, one sub-tank 40 will be called a first sub-tank 40*a* and the other sub-tank 40 will be called a second sub-tank 40*b*. The sub-tanks 40 will be described in detail later.

The consumable article consumption apparatus 30 includes an outer shell 31 that forms an outer surface, a controller 32, an emitter 60, a display unit 34, and multiple slots 90. The controller 32 is arranged inside of the outer shell 31 and controls the operation of the consumable article consumption apparatus 30. The controller 32 will be described in detail later.

The multiple slots 90 form sub-tank mounting portions at which the sub-tanks 40 are detachably attached. Two of the multiple slots 90 are provided for each of the main tanks 20 containing consumable articles with different attributes (in this embodiment, colors). That is, two of the multiple slots 90 are provided for each consumable article of one type (cyan ink, magenta ink, yellow ink, black ink).

Each of the multiple slots 90 includes a flow path connection portion 715, an electrical contact portion 902, and a relay substrate 904. The flow path connection portion 715 is a hollow needle-shaped member that is connected to a sub-tank 40. The flow path connection portion 715 communicates with the main tank 20 and later-described ejection ports 63 included in the discharge portion 60. Accordingly, the sub-tank 40 can be refilled with the consumable article from the main tank 20 and can supply consumable article to the discharge portion 60. The electrical contact portion 902 is an electrically conductive member that is electrically connected to the circuit board 402 due to coming into contact with the circuit board 402 of the sub-tank 40. Nine (only two are shown in FIG. 2) electrical contact portions 902 are provided. The relay substrate 904 is electrically connected to the electrical contact portion 902 and the controller 32. The relay substrate 904 includes a storage unit such as a non-volatile memory, and information configured to identify the slots 90 (e.g., slot identifiers) is stored in the storage unit.

Here, slots 90 having flow path connection portions 715 that communicate with the main tank 20C will be called slots 90C, one of the two slots 90C will be called a slot 90C1, and the other will be called a slot 90C2 (see FIG. 2). Slots 90 having flow path connection portions 715 that communicate with the main tank 20M will be called slots 90M, one of the two slots 90M will be called a slot 90M1, and the other will be called a slot 90M2. Slots 90 having flow path connection portions 715 that communicate with the main tank 20Y will be called slots 90Y, one of the two slots 90Y will be called a slot 90Y1, and the other will be called a slot 90Y2. Slots 90 having flow path connection portions 715 that communicate with the main tank 20K will be called slots 90K, one of the two slots 90K will be called a slot 90K1, and the other will be called a slot 90K2.

The flow path connection portions 715 of the two slots 90C1 and 90C2 are connected in parallel with the ejection ports 63 that discharge the cyan consumable article. The flow path connection portions 715 of the two slots 90M1 and 90M2 are connected in parallel with the ejection ports 63 that discharge the magenta consumable article. The flow path connection portions 715 of the two slots 90Y1 and 90Y2 are connected in parallel with the ejection ports 63 that discharge the yellow consumable article. The flow path connection portions 715 of the two slots 90K1 and 90K2 are connected in parallel with the ejection ports 63 that discharge the black consumable article.

The discharge portion 60 is a printing head that moves reciprocally along a predetermined direction (X direction in FIG. 1) due to a drive mechanism (not shown). The discharge portion 60 has a nozzle line 61 that discharges (ejects) the consumable article (in the present embodiment, ink) onto a medium. Four nozzle lines 61 are provided. In the case of using the four nozzle lines 61 with a distinction made therebetween, reference signs "61C", "61M", "61Y", and "61K" are used. The nozzle lines 61C to 61K include multiple ejection ports 63. The nozzle line 61C ejects cyan ink supplied from one of the two sub-tanks 40C1 and 40C2. The nozzle line 61M ejects magenta ink supplied from one of the two sub-tanks 40M1 and 40M2. The nozzle line 61Y ejects yellow ink supplied from one of the two sub-tanks 40Y1 and 40Y2. The nozzle line 61K ejects black ink supplied from one of the two sub-tanks 40K1 and 40K2. When recording (printing) is performed by ejecting the ink onto the medium, the discharge portion 60 moves reciprocally along the X direction, and the medium moves along a +Y direction that is orthogonal to the X direction inside of the outer shell 31 due to a conveying mechanism (not shown). Note that in another embodiment, the discharge portion 60 may be a line head that has a fixed position instead of moving reciprocally.

As described above, the discharge portion 60 includes multiple types of ejection ports 63 for ejecting the multiple types (cyan, magenta, yellow, and black) of consumable articles to the medium. The multiple types of ejection ports 63 are formed in the nozzle lines 61C to 61K and eject consumable articles with different attributes.

The display unit 34 is arranged at a position of being visible by a user. The display unit 34 is a liquid crystal monitor that is arranged on the upper surface or front surface of the outer shell 31, for example. The display unit 34 displays information relating to the consumable article consumption system 10, such as messages, in response to a request from the controller 32 or the user.

The consumable article consumption apparatus 30 further includes a first replenishment flow path 71 and a second replenishment flow path 74 that allow the main consumable article containing portion 23 of the main tank 20 and the consumable article containing portion 44 of the corresponding sub-tank 40 to communicate, and a first supply flow path 77, a second supply flow path 78, and a merging supply flow path 79 that allow the consumable article containing portion 44 and the discharge portion 60 to communicate. The first replenishment flow path 71 and the second replenishment flow path 74 branch from the connection flow path 75.

Four of each of the flow paths 71, 74, 75, 77, 78, and 79 are provided in correspondence with the four main tanks 20C to 20K. Note that only the flow paths 71, 74, 75, 77, 78, and 79 provided in correspondence with the main tank 20C are illustrated in FIG. 1, but the flow paths 71, 74, 77, 78, and 79 provided in correspondence with the other main tanks 20M, 20Y, and 20K have similar configurations.

The connection flow path 75 includes a connection portion (not shown) that is detachably connected to the liquid supply portions of the main tank 20 at one end portion. The other end portion of the connection flow path 75 branches into the first replenishment flow path 71 and the second replenishment flow path 74.

The first replenishment flow path 71 allows the main consumable article containing portion 23 of the main tank 20 and the consumable article containing portion 44 of the first sub-tank 40*a* to communicate via the connection flow path 75. One end portion of the first replenishment flow path 71 is connected to the flow path connection portion 715 provided on the slot 90. The first replenishment flow path 71 is for replenishing the consumable article of the main tank 20 in the first sub-tank 40*a*. A first opening/closing valve 81 and a first replenishment valve 82 are arranged on the first replenishment flow path 71. The first opening/closing valve 81 is arranged outside of the outer shell 31 and can be operated by the user. The first opening/closing valve 81 opens and closes the first replenishment flow path 71. For example, when a user replaces a main tank 20, the user closes the first opening/closing valve 81, and thereafter removes the main tank 20 from the first replenishment flow path 71, and after connecting a new main tank 20 to the first replenishment flow path 71, the user opens the first opening/closing valve 81. Also, the first opening/closing valve 81 can open and close according to an instruction from the operation controller 322. The first replenishment valve 82 opens and closes according to an instruction from the operation controller 322 and opens and closes the first replenishment flow path 71.

The second replenishment flow path 74 allows the main consumable article containing portion 23 of the main tank 20 and the consumable article containing portion 44 of the second sub-tank 40*b* to communicate via the connection flow path 75. One end portion of the second replenishment flow path 74 is connected to the flow path connection portion 715 provided on the slot 90. The second replenishment flow path 74 is for replenishing the liquid in the main tank 20 in the second sub-tank 40*b*. A second opening/closing valve 84 and a second replenishment valve 85 are arranged on the second replenishment flow path 74. The second opening/closing valve 84 is arranged outside of the outer shell 31 and is operated by the user. For example, when a user replaces a main tank 20, the user closes the second opening/closing valve 84, and thereafter removes the main tank 20 from the second replenishment flow path 74, and after connecting a new main tank 20 to the second replenishment flow path 74, the user opens the second opening/closing valve 84. Also, the second opening/closing valve 84 can open and close according to an instruction from the operation controller 322. The second replenishment valve 85 opens and closes according to an instruction from the operation controller 322 and opens and closes the second replenishment flow path 74.

The first supply flow path 77 is connected to a portion between the first replenishment valve 82 and the first opening/closing valve 81 on the first replenishment flow path 71. The first supply valve 83 is arranged on the first supply flow path 77. The first supply path 83 opens and closes according to an instruction from the controller 32.

The second supply flow path 78 is connected to a portion between the second replenishment valve 85 and the second opening/closing valve 84 on the second replenishment flow path 74. The second supply valve 86 is arranged on the second supply flow path 78. The second supply path 86 opens and closes according to an instruction from the controller 32.

The merging supply flow path 79 is the flow path in which the first supply flow path 77 and the second supply flow path 78 merge. The merging supply flow path 79 communicates with the discharge portion 60 (specifically, the corresponding nozzle line 61).

If the consumable article is to be replenished in the first sub-tank 40*a* from the main tank 20, the first opening/closing valve 81 is opened, the first supply valve 83 is closed, and the first replenishment valve 82 is opened. The open/closed state of these valves is called a first replenishment-enabled state. Accordingly, it is possible to replenish the consumable article in the first sub-tank 40*a* from the main tank 20 via the first replenishment flow path 71. If the consumable article is to be replenished in the second sub-tank 40*b* from the main tank 20, the second opening/closing valve 84 is opened, the second supply valve 86 is closed, and the second replenishment valve 85 is opened. The open/closed state of these valves is called a second replenishment-enabled state. Accordingly, it is possible to replenish the consumable article in the second sub-tank 40*b* from the main tank 20 via the second replenishment flow path 74.

If the consumable article is to be supplied from the first sub-tank 40*a* to the discharge portion 60, the first opening/closing valve 81 is closed, the first replenishment valve 82 is opened, and the first supply valve 83 is opened. The open/closed state of these valves is called a first supply-enabled state. Accordingly, it is possible to supply the consumable article from the first sub-tank 40*a* to the discharge portion 60 via a portion of the first supply flow path 71, the first supply flow path 77, and the merging supply flow path 79 from the first sub-tank 40*a*. If a liquid is to be supplied from the second sub-tank 40*b* to the discharge portion 60, the second opening/closing valve 84 is closed, the second replenishment valve 85 is opened, and the second supply valve 86 is opened. The open/closed state of these valves is called a second supply-enabled state. Accordingly, it is possible to supply the consumable article from the second sub-tank 40*b* to the discharge portion 60 via a portion of the second supply flow path 74, the second supply flow path 78, and the merging supply flow path 79 from the second sub-tank 40*b*.

The first flow path pressure sensor 88 is arranged at the first connection portion of the first replenishment flow path 71 and the first supply flow path 77. The first flow path pressure sensor 88 detects the flow path pressure of the first connection portion and transmits the detection result to the controller 32. A second flow path pressure sensor 89 is arranged at a second connection portion of the second replenishment flow path 74 and the second supply flow path 78. The second flow path pressure sensor 89 detects the flow path pressure of the second connection portion and transmits the detection result to the controller 32.

In order to replenish the consumable article in the sub-tank 40 from the main tank 20, the replenishment pump 52 (FIG. 2) sets the interior of the case 42 of the sub-tank 40 in which replenishment is to be performed to a predetermined pressure reduction state. Also, replenishment opening/closing valves 523 to 530 are arranged on the flow paths that allow the replenishment pump 52 and the sub-tanks 40 to communicate. The replenishment opening/closing valves 523 to 530 are controlled by the controller 32. Also, a flow path 580 that branches from the flow path located between the replenishment pump 52 and the replenishment opening/closing valves 523 to 530 is provided. This flow path 580 communicates with the atmosphere. An atmosphere release valve 53 that is controlled by the controller 32 is arranged on the flow path 580.

The supply pump 54 is used to put the interior of the case 42 of the sub-tank 40 that is the supply source into a pressure increase state up to a predetermined pressure in order to supply the consumable article from the sub-tank 40 to the discharge portion 60. Also, supply opening/closing valves 543 to 550 are arranged on the flow paths that allow the supply pump 54 and the sub-tanks 40 to communicate. The supply opening/closing valves 543 to 550 are controlled by the controller 32. Also, a flow path 581 is provided which branches from the flow path located between the supply opening/closing valves 543 to 550 and the supply pump 54. This flow path 581 communicates with the atmosphere. The opening/closing valve 55 that is controlled by the controller 32 is arranged on the flow path 581. As a rule of thumb, the opening/closing valve 55 is open only when the power source of the consumable article consumption apparatus 30 is off.

Figure 3:
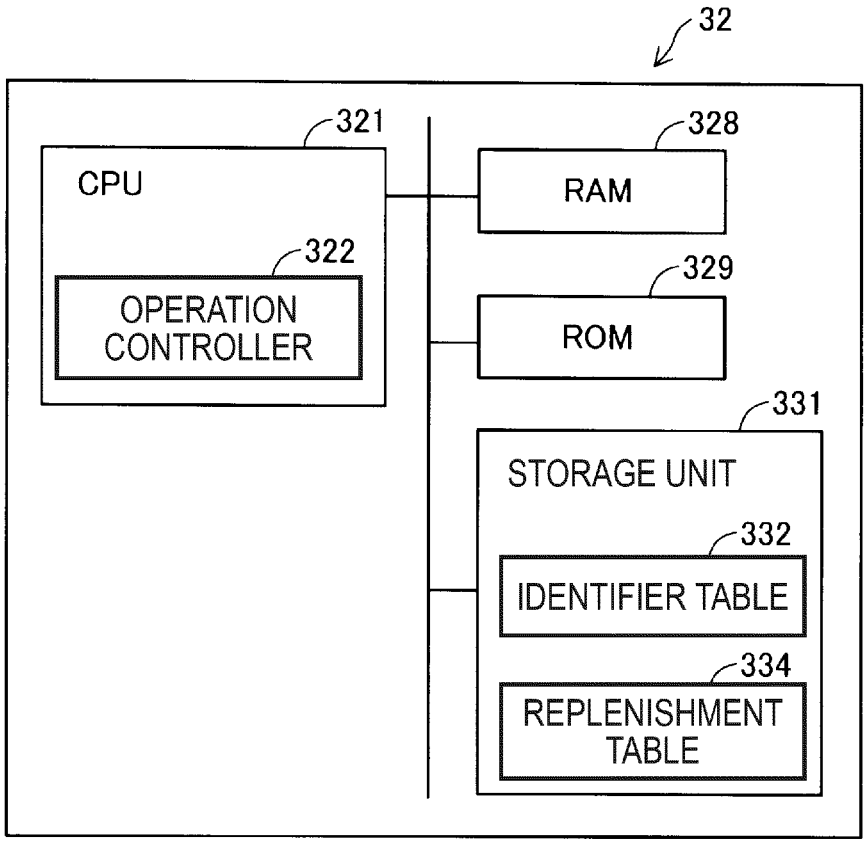
FIG. 3 is a block diagram of the interior of a controller.

The details of the controller 32 will be described with reference to FIGS. 3 to 5. FIG. 3 is a block diagram of the interior of the controller 32. FIG. 4 is a diagram showing an identifier table 332. FIG. 5 is a diagram showing a replenishment table 334.

The controller 32 (FIG. 3) includes a CPU 321, a RAM 328, a ROM 329, and a main body-side storage unit 331. The CPU 321 includes an operation controller 322 as a device that operates due to various programs stored in the ROM 329 being expanded to the RAM 328 and executed.

The operation control unit 322 controls replenishment of the consumable article in the sub-tank 40 from the main tank 20, supply of the consumable article from the sub-tank 40 to the discharge portion 60, and the like. For example, the operation controller 322 switches the sub-tanks 40*a* and 40*b* (two in the present embodiment) of each of the multiple sub-tank sets 72 to supply-side sub-tanks 40B (FIG. 2) that can supply the consumable article to the ejection port 63 and replenishment-side sub-tanks 40A (FIG. 2) that can replenish the consumable article from the main tank 20. At a predetermined timing, the replenishment-side sub-tank 40A is switched to a supply-side sub-tank 40B and the supply-side sub-tank 40B that has not been switched is switched to a replenishment-side sub-tank 40A. Here, in the multiple (in this embodiment, two) sub-tanks 40 in a sub-tank set 72, while one sub-tank 40 (e.g., the first sub-tank 40*a*) supplies the consumable article to the ejection port 63 in the period up to when the switching is performed, the remaining sub-tank (e.g., the second sub-tank 40*b*) is controlled so as not to supply the consumable article to the ejection port 63.

Also, the operation controller 322 controls operations relating to the sub-tanks 40 mounted in the slots 90. For example, when a sub-tank 40 is first mounted on one of the multiple slots 90, the operation controller 322 stores the consumable article information in the circuit board 402 (specifically, the sub-tank-side storage unit) of the mounted sub-tank 40. The consumable article information is information relating to the attribute (type) of the consumable article to be replenished from the main tank 20, and in the present embodiment, it is information indicating the ink color. The consumable article information stored in the sub-tank 40 is also called sub-tank-side consumable article information. Also, the consumable article information is associated with each of the multiple slots 90 and is stored as main body-side consumable article information in the identifier table 332. For example, the consumable article information associated with the slot 90C is "cyan", the consumable article information associated with the slot 90M is "magenta", the consumable article information associated with the slot 90Y is "yellow", and the consumable article information associated with the slot 90K is "black".

The main body-side storage unit 331 (FIG. 3) is a data rewritable memory, and in the present embodiment, for example, a flash memory is used thereas. The main body-side storage unit 331 includes an identifier table 332 and a replenishment table 334.

The identifier table 332 (FIG. 4) includes a slot identifier region, a main body-side consumable article information region, and a main body-side identifier region. Unique slot identifiers configured to identify the multiple slots 90 included in the consumable article consumption apparatus 30 are stored in the slot identifier region. The slot identifier "SC1*a*" is attributed to the slot 90C1, "SC2*a*" is attributed to the slot 90C2, "SM1*a*" is attributed to the slot 90M1, "SM2*a*" is attributed to the slot 90M2, "SY1*a*" is attributed to the slot 90Y1, "SY2*a*" is attributed to the slot 90Y2, "SK1*a*" is attributed to the slot 90K1, and "SK2*a*" is attributed to the slot 90K2. Unique slot identifiers are attributed also to slots of another consumable article consumption apparatus 30 with the same configuration (model). For example, in the other consumable article consumption apparatus 30, the slot identifier "SC1*b*" is attributed to the slot 90C1, "SC2*b*" is attributed to the slot 90C2, "SM1*b*" is attributed to the slot 90M1, "SM2*b*" is attributed to the slot 90M2, "SY1*b*" is attributed to the slot 90Y1, "SY2*b*" is attributed to the slot 90Y2, "SK1*b*" is attributed to the slot 90K1, and "SK2*b*" is attributed to the slot 90K2.

The main body-side consumable article information is stored in association with the slot identifiers in the main body-side consumable article information region. The main body-side identifier region is a region in which the sub-tank-side identifier of the sub-tank 40 that was first mounted in the slot 90 is stored in association with the slot identifier as main body-side identifier.

The replenishment table 334 (FIG. 5) includes a slot identifier region, a replenishment amount region, a consumption amount region, a consumable article remaining amount region, a pressure increase instance count region, and a pressure reduction instance count region. The same information (slot identifier information) as that in the slot identifier region of the identifier table 332 is stored in the slot identifier region. The replenishment amount region is a region that stores the replenishment amount information of the consumable article replenished in the sub-tank 40 from the main tank 20 due to one instance of later-described replenishment processing, in association with the slot identifiers. The replenishment amount information is updated to the newest information each time the replenishment processing is executed. The consumable article remaining amount region is a region in which the consumable article remaining amount information of the sub-tanks 40 is stored in association with the slot identifiers. The consumable article remaining amount is calculated by the controller 32 based on the replenishment amount information and the consumption amount information (the consumable article amount information supplied to the discharge portion 60 from the sub-tank 40 mounted in the slot 90) of the slot 90 in which a certain sub-tank 40 is mounted. The consumable article remaining amount information associated with the slot identifiers is updated every predetermined consumption amount (e.g., every 2 ml) of the consumable article for each slot identifier. The consumption amount of the consumable article is estimated by the controller 32 based on an amount consumed per dot and a count, by counting the dots ejected from the discharge portion 60 when the sub-tank 40 mounted in the slot 90 functions as a supply-side sub-tank 40B.

The pressure increase instance count region is a region in which the instance count information of the pressure increase state, which is executed on the sub-tanks 40 mounted in the slots 90, is stored in association with the slot identifiers. The pressure reduction instance count region is a region in which the instance count information of the pressure reduction state, which is executed on the sub-tank 40 mounted in the slot 90 is stored in association with the slot identifiers.

The replenishment amount information, the consumption amount information, the consumable article remaining amount information, the pressure increase instance count information, and the pressure reduction instance count information are included in sub-tank-related information. If the total value of the pressure increase instance count and the pressure reduction instance count reaches a predetermined threshold, the controller 32 determines that the lifespan of the sub-tank 40 mounted in the slot 90 that has reached the threshold has ended. Then, on the display unit 34, the controller 32 displays information prompting replacement of the sub-tank 40 whose lifespan was determined to have ended with a new sub-tank 40.

Note that in the present embodiment, the identifier table 332 and the replenishment table 334 are stored in the main body-side storage unit 331 as separate tables, but they may also be stored as one table.

A-2. Step of Replenishing the Sub-Tank

Figure 6:
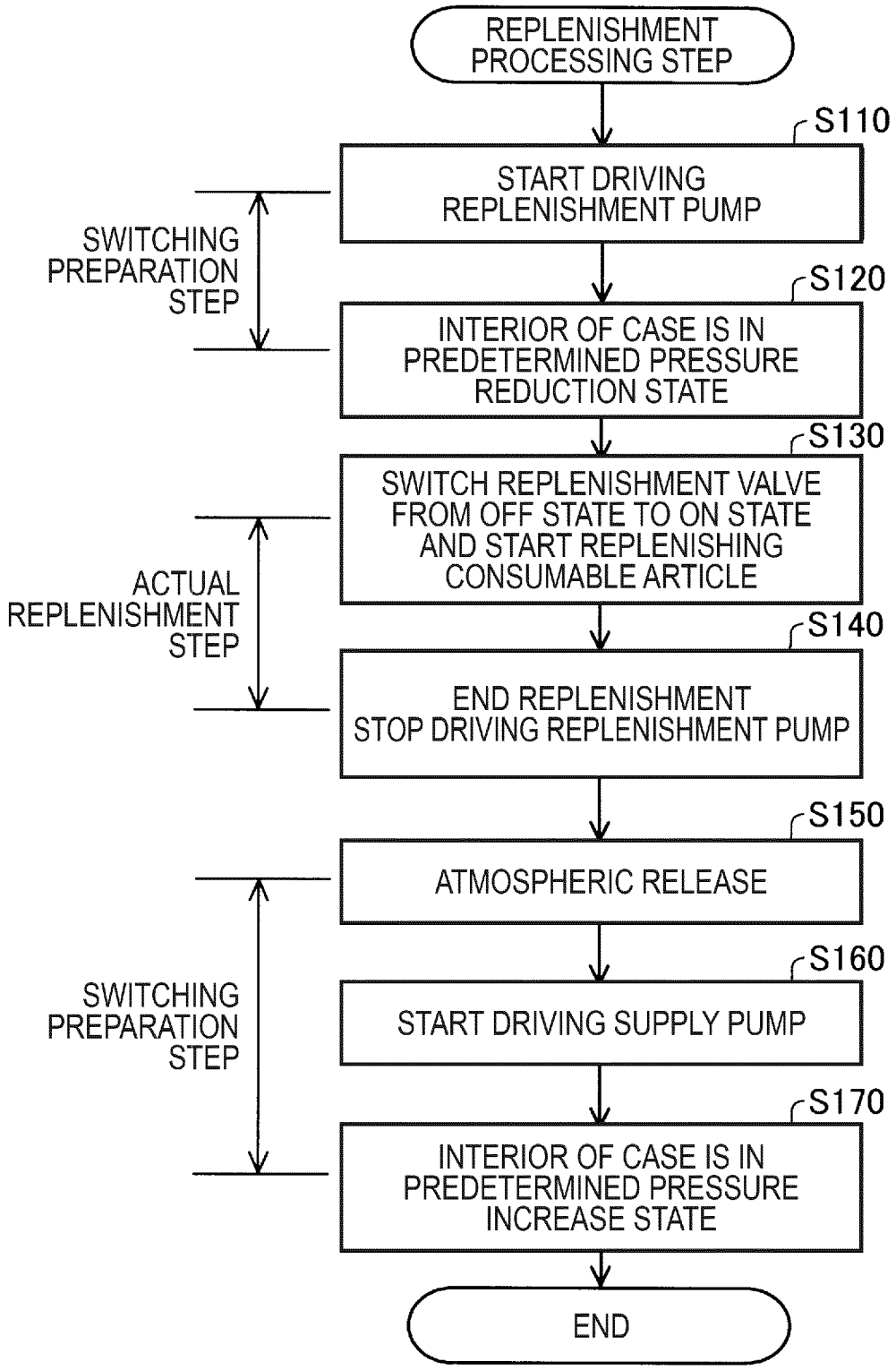
FIG. 6 is a flowchart for illustrating a step of replenishment in the sub-tank.

FIG. 6 is a flowchart for illustrating a step of replenishment processing in the sub-tank 40. The replenishment processing step is executed in the case where any of the following conditions are satisfied, for example.

Condition 1: when an unused sub-tank 40 is first mounted in a slot 90

Condition 2: when a later-described mismatch flag of the sub-tank-side storage unit 420 is set to "1"

Condition 3: when the consumable article remaining amount of the supply-side sub-tank 40B reaches a predetermined threshold In the present embodiment, the maximum capacity of the sub-tank 40 is 900 ml, the replenishment rate (minimum replenishment rate) of the consumable article from the main tank 20 to the replenishment-side sub-tank 40A is at least 50 ml/min with a tolerance included, and the maximum supply rate of the consumable article from the supply-side sub-tank 40B to the discharge portion 60 is at most 20 ml/min with a tolerance included. The maximum supply rate is the consumable article supply rate from the supply-side sub-tank 40B to the discharge portion 60 at the time of performing monochrome solid printing onto a medium.

As shown in FIG. 6, the operation controller 322 opens the opening/closing valves 523 to 530 between the replenishment pump 52 and the replenishment-side sub-tank 40A, and thereafter starts driving the replenishment-side pump 52 (step S110). For example, if the first sub-tank 40*a* of each color is a replenishment-side sub-tank 40A, the operation controller 322 starts driving the replenishment pump 52 by opening the opening/closing valves 523, 525, 527, and 529 shown in FIG. 2, closing the opening/closing valves 524, 526, 528, and 530, and closing the atmosphere release valve 53. On the other hand, in order to cause the second sub-tank 40*b* of each color to function as the supply-side sub-tank 40B, the operation controller 322 opens the opening/closing valves 544, 546, 548, and 550 shown in FIG. 2, closes the opening/closing valves 543, 545, 547, and 549, closes the opening/closing valve 55, and drives the supply pump 54 to supply the consumable article to the discharge portion 60.

After step S110, the operation control unit 322 drives the replenishment pump 52 until the interior of the case 42 of the replenishment-side sub-tank 40A reaches a predetermined pressure reduction state (step S120). The predetermined pressure reduction state is a state in which the interior of the case 42 has a predetermined negative pressure in order to suction the consumable article in the main tank 20. The operation controller 322 detects the pressure in the case 42 using a pressure sensor 56 (FIG. 1) of the replenishment-side sub-tank 40A. The operation controller 322 drives the replenishment pump 52 such that the predetermined pressure reduction state is maintained until the replenishment of the replenishment-side sub-tank 40A is complete.

Next, the operation controller 322 switches the first replenishment valve 82 (FIG. 1) from the closed state to the open state, and starts replenishing the consumable article from the main tank 20 to the replenishment-side sub-tank 40A (step S130). In step S130, the first opening/closing valve 81 (FIG. 1) is set to the open state. By switching the first replenishment valve 82 from the closed state to the open state, the consumable article in the main consumable article containing portion 23 is suctioned into the consumable article containing portion 44 of the replenishment-side sub-tank 40A via the first replenishment flow path 71.

After the replenishment in the replenishment-side sub-tank 40A ends, the operation controller 322 stops driving the replenishment pump 52 in order to cancel the pressure reduction state in the case 42 of the replenishment-side sub-tank 40A (step S140). Also, in step S140, the operation controller 322 switches the first replenishment valve 82 from the open state to the closed state, and thus the first supply flow path 71 (FIG. 1) that allows the consumable article to flow through from the main tank 20 to the replenishment-side sub-tank 40A is set to a non-communicating state. Note that the amount of time for which the consumable article is actually replenished until the consumable article remaining amount of the replenishment-side sub-tank 40A is filled from zero to the maximum capacity (900 ml) is 18 minutes in the present embodiment. The steps of step S3 and step S4 are also referred to collectively as an actual replenishment step.

After step S140, the replenishment-side sub-tank 40A is subjected to atmospheric release (step S150). Atmospheric release is a state in which the replenishment pump 52 and the supply pump 54 are not driven with respect to the replenishment-side sub-tank 40A, and is a step for setting the pressure in the case 42 that is at a negative pressure to the atmospheric pressure. The pressure change from the negative pressure to the atmospheric pressure is performed by opening the atmospheric release valve 53 shown in FIG. 2, which is between the replenishment pump 52 and the opening/closing valves 523 to 530, and due to the external air being taken into the case 42 via the flow path 580. The operation controller 322 ends step S150 when the pressure in the case 42 detected by the pressure sensor 56 reaches the atmospheric pressure. Note that the amount of time needed to set the pressure reduction state in the case 42 to the atmospheric pressure state is several seconds, and is included in the amount of time for executing a later-described switching preparation step.

After step S150, the operation controller 322 opens the opening/closing valves 543, 545, 547, and 549 between the supply pump 54 and the replenishment-side sub-tank 40A, and thereafter starts driving the supply pump 54 (step S160). The operation controller 322 drives the supply pump 54 (step S170) until the interior of the case 42 of the replenishment-side sub-tank 40A reaches a predetermined pressure increase state. The predetermined pressure increase state is a pressure state for supplying the consumable article to the discharge portion 60, and is a state in which the interior of the case 42 is at a higher pressure than the predetermined atmospheric pressure. Accordingly, the replenishment-side sub-tank 40A is switched to a supply-side sub-tank 40B and the consumable article can be supplied to the discharge portion 60. In actuality, by performing control such that the first opening/closing valve 81 is closed, the first replenishment valve 82 is open, and the first supply valve 83 is open, the replenishment-side sub-tank 40A is set as a supply-side sub-tank 40B and supply of the consumable article to the discharge portion 60 is started.

Here, the steps of step S110, step S120, and steps S150 to S170 are steps that do not accompany replenishing of the consumable article from the main tank 20 and supply of the consumable article to the discharge portion 60, and can be said to be steps that are needed for pressure control for switching between the replenishment-side sub-tank 40A, which can replenish the consumable article from the main tank 20, and the supply-side sub-tank 40B. Accordingly, the steps of step S110, step S120, and steps S150 to S170 are also called switching preparation steps. In the present embodiment, the amount of time for executing the switching preparation steps (also called "switching preparation time A") is 6 minutes, and the amount of time B for executing the actual replenishment step is 18 minutes at most. The switching preparation time is the amount of time needed for switching between the replenishment-side sub-tank 40A and the supply-side sub-tank 40B, and is the amount of time for which pressure control for switching is performed.

A-3. Detailed Description of Sub-Tank 40

Figure 7:
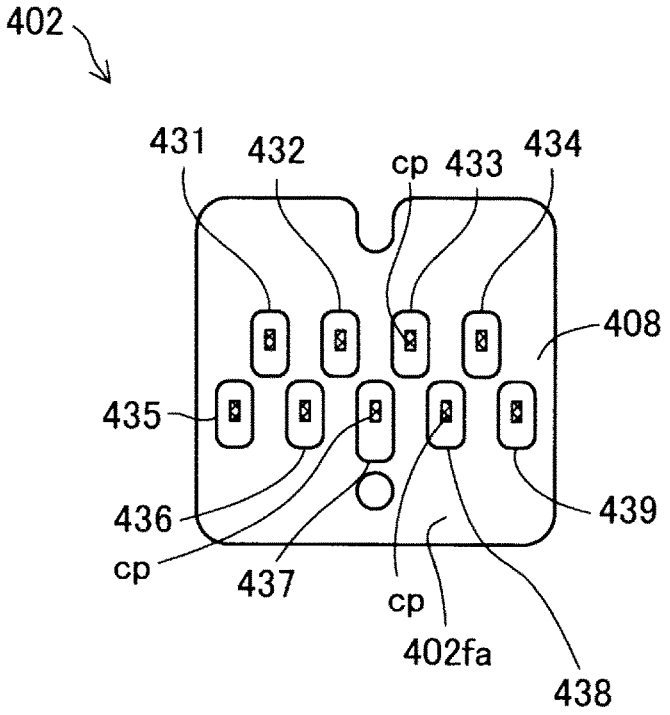
FIG. 7 is a front view of a circuit board.
Figure 8:
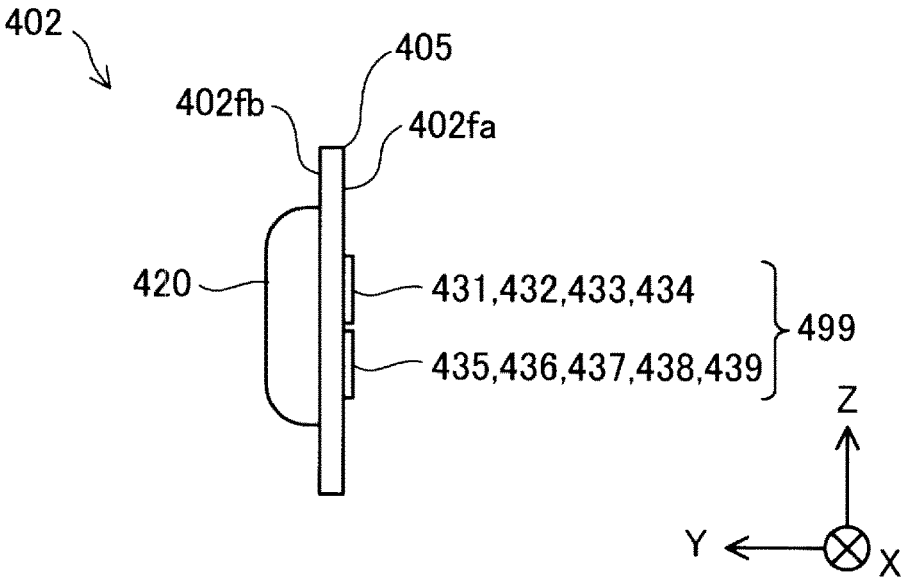
FIG. 8 is a side view of a circuit board.
Figure 9:
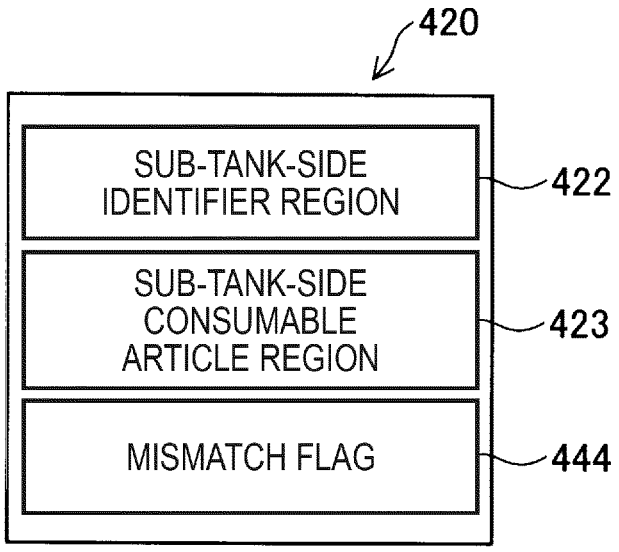
FIG. 9 is a diagram for illustrating a sub-tank-side storage unit.

The sub-tank 40 will be described in detail with reference to FIGS. 7 to 9, as well as FIG. 1. FIG. 7 is a front view of the circuit board 402. FIG. 8 is a side view of the circuit board 402. FIG. 9 is a diagram for illustrating a sub-tank-side storage unit 420.

The sub-tank 40 (FIG. 1) includes a case 42, a consumable article containing portion 44 contained in the case 42, a consumable article flow-through portion 47, and a circuit board 402. The case 42 is an approximately cuboid-shaped housing that contains the consumable article containing portion 44. The case 42 has a shape that can be detachably attached to multiple slots 90 or the slots 90 of another consumable article consumption apparatus 30.

The consumable article containing portion 44 can store a consumable article to be supplied to the discharge portion 60. The consumable article containing portion 44 is a flexible bag, and its volume decreases as the consumable article is consumed. The consumable article containing portion 44 does not contain the consumable article in an unused state prior to first being attached to the slot 90. When the sub-tank 40 is first mounted in the slot 90, the consumable article containing portion 44 contains the consumable article due to the consumable article being replenished from the main tank 20 that communicates with the slot 90 that is the mounting destination.

The consumable article flow-through portion 47 is connected to the consumable article containing portion 44 and communicates with the consumable article containing portion 44. The consumable article flow-through portion 47 is a tube-shaped member and is connected due to the flow path connection portion 715 being inserted when the sub-tank 40 is mounted in the slot 90. Accordingly, it is possible to replenish the consumable article from the main tank 20 to the sub-tank 40 and to supply the consumable article from the sub-tank 40 to the discharge portion 60.

The circuit board 402 (FIG. 1) is attached to the surface of the case 42. The circuit board 402 (FIG. 7) includes a sub-tank-side terminal group 499 (FIG. 8) that is provided on the surface 402*fa* and a sub-tank-side storage unit 420 that is provided on the under surface 402*fb*.

The sub-tank-side terminal group 499 (FIG. 7) is composed of nine sub-tank terminals 431 to 439. The nine sub-tank-side terminals 431 to 439 are each formed into an approximately rectangular shape and include a contact portion cp that comes into contact with the corresponding electrical contact portion 902 provided in the slot 90.

The sub-tank-side terminals 431 to 439 can be referred to as follows based on their functions (applications).

(1) Mounting detection terminal (first terminal) 435
(2) Power source terminal 436
(3) Grounding terminal 437
(4) Data terminal 438
(5) Mounting detection terminal (second terminal) 439
Second terminal line RN2
(6) Mounting detection terminal (third terminal) 431
(7) Reset terminal 432
(8) Clock terminal 433
(9) Mounting detection terminal (fourth terminal) 434

The four mounting detection terminals 431, 434, 435, and 439 are used to detect whether or not the sub-tanks 40 have been mounted in the slots 90 due to the controller 32 detecting whether or not the electrical contact with the corresponding electrical contact portion 902 (FIG. 1) provided in the slot 90 is suitable. Accordingly, the four mounting detection terminals 431, 434, 435, and 439 can also be called a "mounting detection terminal group". In the present embodiment, the four mounting detection terminals 431, 434, 437, and 439 are electrically connected to each other inside of the circuit board 402, and when the sub-tanks 40 are mounted in the slots 90, they are electrically connected to a grounding line (not shown) of the consumable article consumption apparatus through the grounding terminal 437.

The other five terminals 432, 433, 436, 437, and 438 are terminals for the sub-tank-side storage unit 420. Accordingly, the five terminals 432, 436, 437, and 438 can also be called a "storage portion terminal group".

The reset terminal 432 receives supply of a reset signal RST for the sub-tank-side storage unit 420. The clock terminal 433 receives supply of a clock signal SCK for the sub-tank-side storage unit 420. The power source terminal 436 receives supply of a power source voltage VDD (e.g., a rated power 3.3 V) for the sub-tank-side storage unit 420. The grounding terminal 437 receives supply of a grounding voltage VSS (0 V) for the sub-tank-side storage unit 420. The data terminal 438 receives supply of a data signal SDA that is exchanged between the sub-tank-side storage unit 420 and the main body-side storage unit 331.

The sub-tank-side storage unit 420 is a data rewritable memory, and in the present embodiment, for example, a flash memory is used thereas. The sub-tank-side storage unit 420 (FIG. 9) includes a sub-tank-side identifier region 422, a sub-tank-side consumable article information region 423, and a mismatch flag 444.

The sub-tank-side identifier region 422 stores unique sub-tank-side identifiers configured to distinguish from other sub-tanks 40. The sub-tank-side identifier is stored in the sub-tank-side identifier region 422 in the unused state prior to first being mounted in the slot 90. The sub-tank-side identifiers are the identifiers "TA11" to "TA18", and the like, which are stored in the main body-side identifier region shown in FIG. 4.

The sub-tank-side consumable article information region 423 is a region in which, after the sub-tank 40 is first mounted in the slot 90 and the consumable article is replenished in the consumable article containing portion 44 from the main tank 20, the main body-side consumable article information associated with the slot 90 (slot identifier) that is the mounting destination is written as sub-tank-side consumable article information. That is, in the state after the sub-tank 40 is first mounted in the slot 90 and the consumable article is replenished in the consumable article containing portion 44 from the main tank 20, the sub-tank-side storage unit 420 stores the sub-tank-side consumable article information (e.g., the consumable article information such as "cyan" or "magenta") relating to the attribute of the consumable article that was replenished in the consumable article containing portion 44.

The mismatch flag 444 includes information configured to identify that the sub-tank 40 was mounted in the slot 90 of another consumable article consumption apparatus 30 when the sub-tank 40 is mounted in the slot 90 of the other consumable article consumption apparatus 30 that is different from the consumable article consumption apparatus 30 in which it was first mounted. When the sub-tank 40 is mounted on another consumable article consumption apparatus 30, the controller 32 of the other consumable article consumption apparatus 30 sets the mismatch flag to "1". Information indicating that the mismatch flag has been set to "1" corresponds to "identification information" for solving the problem to be solved. Note that when the sub-tank 40 has not been mounted on another consumable article consumption apparatus 30, the mismatch flag is set to "0". The slot 90 (other apparatus slot 90) of the other consumable article consumption apparatus 30 for which the mismatch flag is set to "1" is described below. That is, the other apparatus slot 90 is a slot 90 that is associated with main body-side consumable article information that is the same (the same ink color) as the sub-tank-side consumable article information stored in the sub-tank-side storage unit 420. More specifically, in the present embodiment, the other apparatus slot 90 is a slot 90 for replenishing the consumable article with the same color as the consumable article contained in the sub-tank 40 from the main tank 20 and for supplying the consumable article to the discharge portion 60.

The consumable article remaining amount and the consumable article consumption amount of the sub-tank 40 are not stored in the sub-tank-side storage unit 420. That is, in the consumable article consumption system 10, the consumable article remaining amount and the consumable article consumption amount are managed by the consumable article consumption apparatus 30. Accordingly, the controller 32 does not need to read and write the consumable article remaining amount and the consumable article consumption amount from and to the sub-tank-side storage unit 420, and therefore the load on the controller 32 can be reduced. Also, the sub-tank 40 can be attached to and detached from the slot 90 and can be carried. Accordingly, there may be a possibility that the data of the sub-tank-side storage unit 420 will be destroyed due to the sub-tank 40 being dropped or colliding with another member. In this case as well, due to the consumable article remaining amount and the consumable article consumption amount being managed (stored) by the consumable article consumption apparatus 30, it is possible to reduce the likelihood that the data on the consumable article remaining amount and the consumable article consumption amount will be damaged. Accordingly, it is possible to reduce the likelihood that the sub-tank 40 will be rendered unusable before the replacement time has been reached.

The sub-tank 40 (FIG. 1) further includes a pressure sensor 56 for detecting the pressure in the case 42, and includes a stirring roller 45 inside of the case 42. The pressure sensor 56 detects the pressure inside of the case 42 and transmits the detection result to the controller 32 via the circuit board 402. In FIG. 1, the pressure sensor 56 is located outside of the case 42 in order to facilitate comprehension, but in actuality, it is arranged inside of the case 42. Two stirring rollers 45 are provided sandwiching the consumable article containing portion 44 (in FIG. 1, only one stirring roller 45 is shown). The two stirring rollers 45 are electrically connected to the circuit board 402 and move in the left-right direction in FIG. 1 while sandwiching the consumable article containing portion 44, according to an instruction from the controller 32. Accordingly, the consumable article in the consumable article containing portion 44 is stirred.

A-4. Sub-Tank Management Control Step

Figure 10:
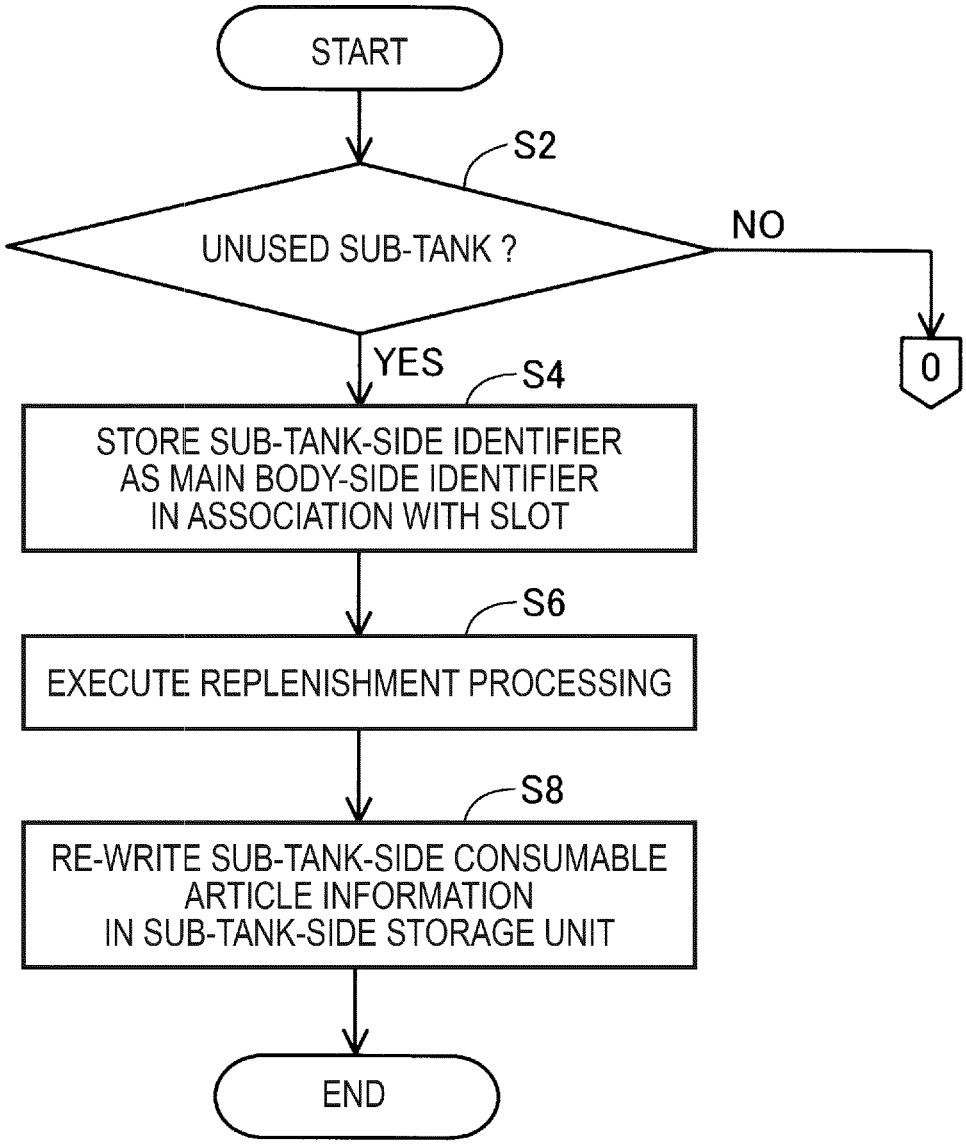
FIG. 10 is a first flowchart for a step of management control of a sub-tank, executed by an operation controller.
Figure 11:
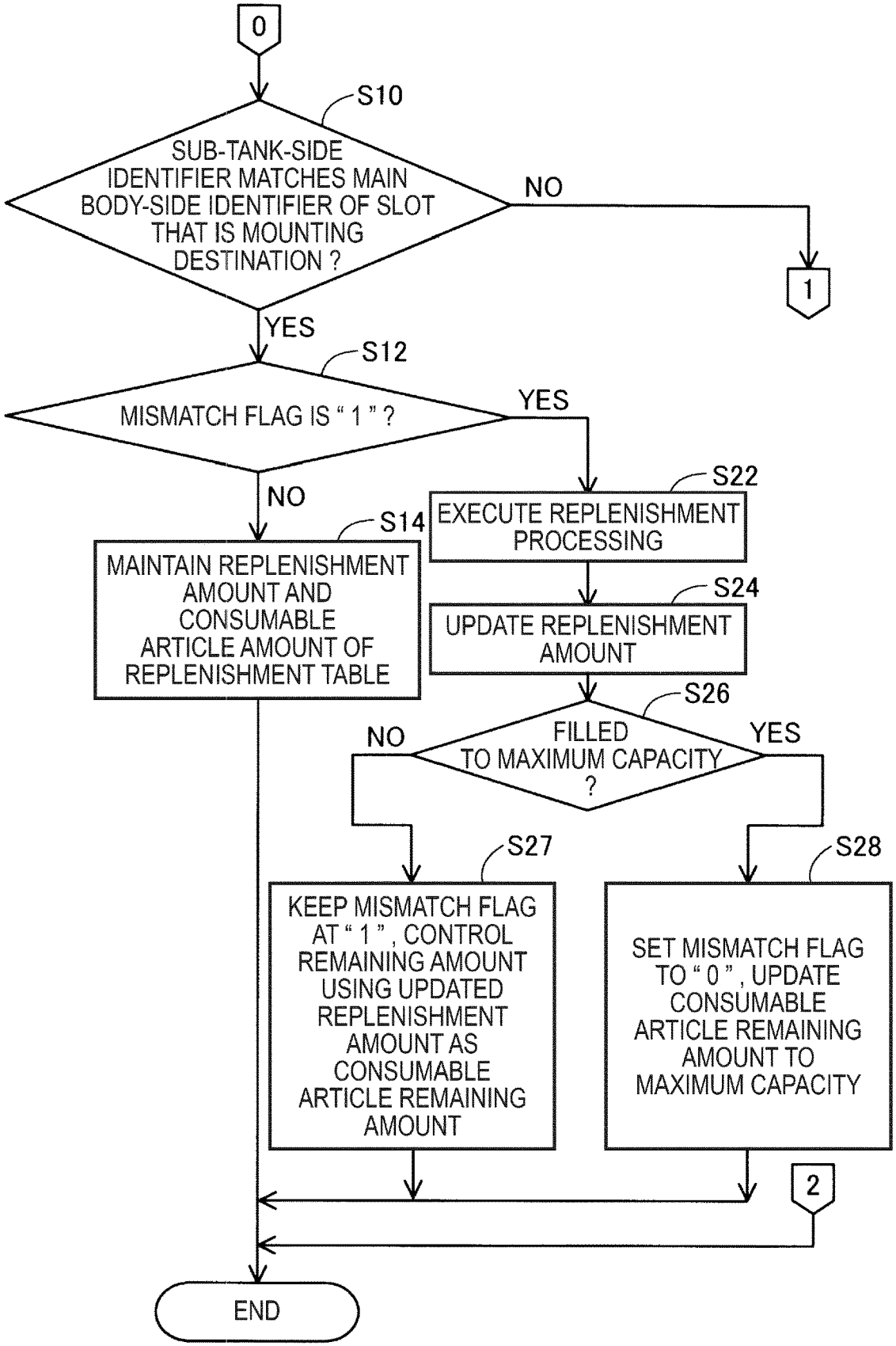
FIG. 11 is a second flowchart for a step of management control of a sub-tank, executed by the operation controller.
Figure 13:
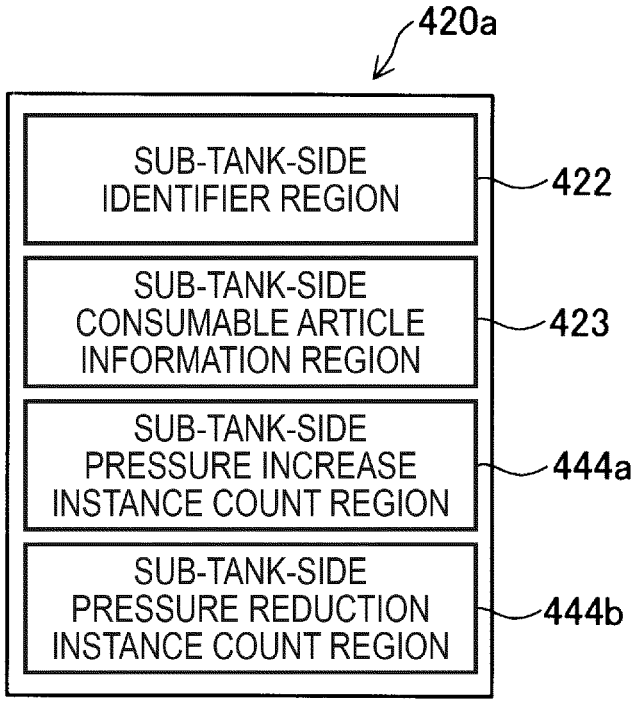
FIG. 13 is a diagram for illustrating a sub-tank-side storage unit of a second embodiment.

FIG. 10 is a first flowchart for the management control step of the sub-tank 40, which is executed by the operation controller 322. FIG. 11 is a second flowchart for the management control step of the sub-tank 40, which is executed by the operation controller 322. FIG. 13 is a third flowchart for the management control step of the sub-tank 40, which is executed by the operation controller 322. As described above, the sub-tanks 40 are interchangeable, and can be used in common in multiple slots 90 or the slots 90 of another consumable article consumption apparatus 30. Also, the sub-tank 40 in which the consumable article was replenished is stirred by being removed from the slot 90 and being shaken, or the like, according to the determination of the user based on stirring recommendation information or the like displayed periodically on the display unit 34. If the sub-tank 40 containing the consumable article is removed from the slot 90, a case may occur in which it is erroneously mounted in a slot 90 other than the slot 90 into which it was originally to be mounted. Even if the sub-tank 40 is mounted in another slot 90, use is possible as long as the slot 90 is associated with the same consumable article information (attribute). Also, if the lifespan of the sub-tank 40 mounted in a certain slot 90 (e.g., the slot 90C1 for cyan ink) ends or the like, the following situation can occur. That is, if an unused sub-tank 40 is not available, a situation may occur in which the user removes the sub-tank 40 whose lifespan has ended from the slot 90 (e.g., the slot 90C1) and mounts a sub-tank 40 of another consumable article consumption apparatus 30, which contains a consumable article with the same attribute (e.g., cyan), in the slot 90 (e.g., the slot 90C1) of the consumable article consumption apparatus 30 that is in use. Thus, a sub-tank 40 that was mounted in another slot 90 can be used if the sub-tank 40 is mounted in another slot 90 that is different from the slot 90 in which the sub-tank 40 was originally to be mounted but has the same attribute (type of color) of the consumable article. Thus, when use is possible even though the sub-tank 40 is mounted in a different slot 90, it is possible to execute the printing operation of the consumable article consumption apparatus 30 in order to reduce the number of operations performed by the user. Note that the management control step for the sub-tank 40, which is to be described below, is executed in order to suppress a case in which the amount of the consumable article contained in the sub-tank 40 reaches zero during a printing operation. The sub-tank 40 is mounted in the slot 90, and thereby the management control step for the sub-tank 40 is executed on the mounted sub-tank 40. The sub-tank 40 mounted in the slot 90 on which the management control step is to be executed is herein also called a target sub-tank 40.

As shown in FIG. 10, if the target sub-tank 40 is mounted in the slot 90, the operation controller 322 determines whether or not the mounted target sub-tank 40 is an unused sub-tank 40 (step S2). It is possible to determine whether or not the target sub-tank 40 is unused based on whether or not the sub-tank-side consumable article information is stored in the sub-tank-side consumable article information region 423 (FIG. 9) of the target sub-tank 40. That is, if no sub-tank-side consumable article information is stored in the sub-tank-side consumable article information region 423, the operation controller 322 determines that the target sub-tank 40 is unused.

If the result of the determination is "YES" in step S2, the operation controller 322 reads out the sub-tank-side identifier of the mounted target sub-tank 40 from the sub-tank-side storage unit 420. Also, the operation controller 322 stores the read-out sub-tank-side identifier associated with the slot 90 (slot identifier) in which the target sub-tank 40 is mounted, in the main body-side identifier region of the main body-side storage unit 331 (FIG. 4) as the main body-side identifier (step S4). After step S4, the operation controller 322 replenishes the consumable article in the consumable article containing portion 44 from the ink tank 20 by executing the replenishment processing on the mounted target sub-tank 40 (step S6). Note that if the replenishment processing is executed, the operation controller 322 stores the newest replenishment amount in the replenishment table 334 (FIG. 5). Also, if the replenishment processing was executed, the operation control unit 322 stores the number of instances of the pressure increase state (pressure increase instance count) and the number of instances of the pressure reduction state (pressure reduction instance count), which were executed in the replenishment processing up to the current time in the slots 90. That is, if the replenishment processing step is executed, the operation controller 322 adds 1 to the pressure increase instance count when the interior of the case 42 is put in a predetermined pressure increase state and adds 1 to the pressure reduction instance count when the interior of the case 42 is put in a predetermined pressure reduction state. The replenishment processing may be the steps from step S110 to step S170 shown in FIG. 6, or the steps from step S110 to step S140.

Next, the operation controller 322 stores, in the sub-tank-side consumable article information region 423 of the sub-tank-side storage unit 420, the main body-side consumable article information associated with the slot 90 in which the target sub-tank 40 is mounted as the sub-tank-side consumable article information (step S8). For example, if an unused sub-tank 40 is mounted in the slot 90C1, "cyan" is stored as the sub-tank-side consumable article information in the sub-tank-side consumable article information region 423.

If the result of the determination is "NO" in step S2, the operation controller 322 determines whether or not the sub-tank-side identifier of the mounted target sub-tank 40 matches the main body-side identifier associated with the slot 90 that is the mounting destination (step S10 in FIG. 11). If the sub-tank-side identifier and the main body-side identifier match, it can be determined that the target sub-tank 40 that was removed from the slot 90 has been correctly returned to the original slot 90. If the result of the determination is "YES" in step S10, the operation controller 322 determines whether or not the mismatch flag is "1" by referencing the sub-tank-side storage unit 420 of the target sub-tank 40 (step S12). If the mismatch flag is not "1" (step S12: NO), it can be determined that the target sub-tank 40 has not been mounted in the slot 90 of another consumable article consumption apparatus 30 in the past. That is, if the mismatch flag is not "1", or in other words, if the mismatch flag is "0", the consumable article contained in the target sub-tank 40 has not been consumed by another consumable article consumption apparatus 30. Accordingly, the operation controller 322 maintains the replenishment amount and the consumable article remaining amount stored in the replenishment table 334 for the slot identifier (target slot identifier) associated with the same main body-side identifier as the sub-tank-side identifier of the target sub-tank 40 (step S14). Thus, the controller 32 performs remaining amount control for the target sub-tank 40 based on the maintained consumable article remaining amount. For example, the operation controller 322 stops supplying the consumable article from the target sub-tank 40 to the discharge portion 60 before the maintained consumable article remaining amount reaches zero.

On the other hand, if the mismatch flag is "1" (step S12: YES), this means that the target sub-tank 40 has been mounted in the slot 90 of another consumable article consumption apparatus 30 in the past. Accordingly, there is a possibility that the consumable article of the target sub-tank 40 has been consumed by the other consumable article consumption apparatus 30. For this reason, there is a possibility that the consumable article remaining amount of the target sub-tank 40 stored in the replenishment table 334 will be less than the actual consumable article remaining amount of the target sub-tank 40. Accordingly, if the result of the determination is "YES" in step S12, the operation controller 322 executes the replenishment processing (step S22). Next, the operation controller 322 updates the replenishment amount associated in the replenishment table 334 with the slot identifier of the slot in which the target sub-tank 40 is mounted, to the replenishment amount obtained by performing replenishing in step S22 (step S24). Next, the operation controller 322 determines whether or not the target sub-tank 40 has been filled to the maximum capacity (900 ml in the present embodiment) (step S26). The determination in step S26 is performed based on the detection values of the flow path pressure sensors 88 and 89 arranged on the flow path that connects the slot 90 in which the target sub-tank 40 is mounted and the main tank 20. Specifically, if the flow path pressure reaches a predetermined threshold value or less in the step of step S22, the operation controller 322 determines that the target sub-tank 40 has been filled to the maximum capacity.

If the result of the determination is "NO" in step S26, the actual consumable article remaining amount of the target sub-tank 40 cannot be determined. Accordingly, the operation controller 322 performs remaining amount control using the replenishment amount that was changed in step S24 as the consumable article remaining amount of the target sub-tank 40 (step S27). Specifically, for example, if the target sub-tank 40 storing the identification information (a mismatch flag of "1") is switched to a supply-side sub-tank 40B, supply of the consumable article to the discharge portion 60 is stopped before the supply amount of the consumable article supplied by the target sub-tank 40 to the discharge portion becomes greater than or equal to the replenishment amount of the consumable article replenished from the main tank 20 in step S22. Accordingly, it is possible to reduce the likelihood that the consumable article in the target sub-tank 40 will run out. Also, if the actual consumable article remaining amount in the target sub-tank 40 cannot be determined, the operation controller 322 keeps the mismatch flag at "1" (step S27). Accordingly, when the target sub-tank 40 is removed from the slot 90 and is once again mounted in the original slot 90, the replenishment processing of step S22 can be executed, and therefore it is possible to fill the target sub-tank 40 with the consumable article to the maximum capacity.

On the other hand, if the result of the determination is "YES" in step S26, it is possible to estimate that the maximum capacity (900 ml) of the consumable article is contained in the target sub-tank 40. Accordingly, the operation controller 322 updates the consumable article remaining amount stored in the replenishment table 334 for the target slot identifier to the maximum capacity (step S28). Also, the operation controller 322 sets the mismatch flag of the target sub-tank 40 to "0" (step S28).

Figure 12:
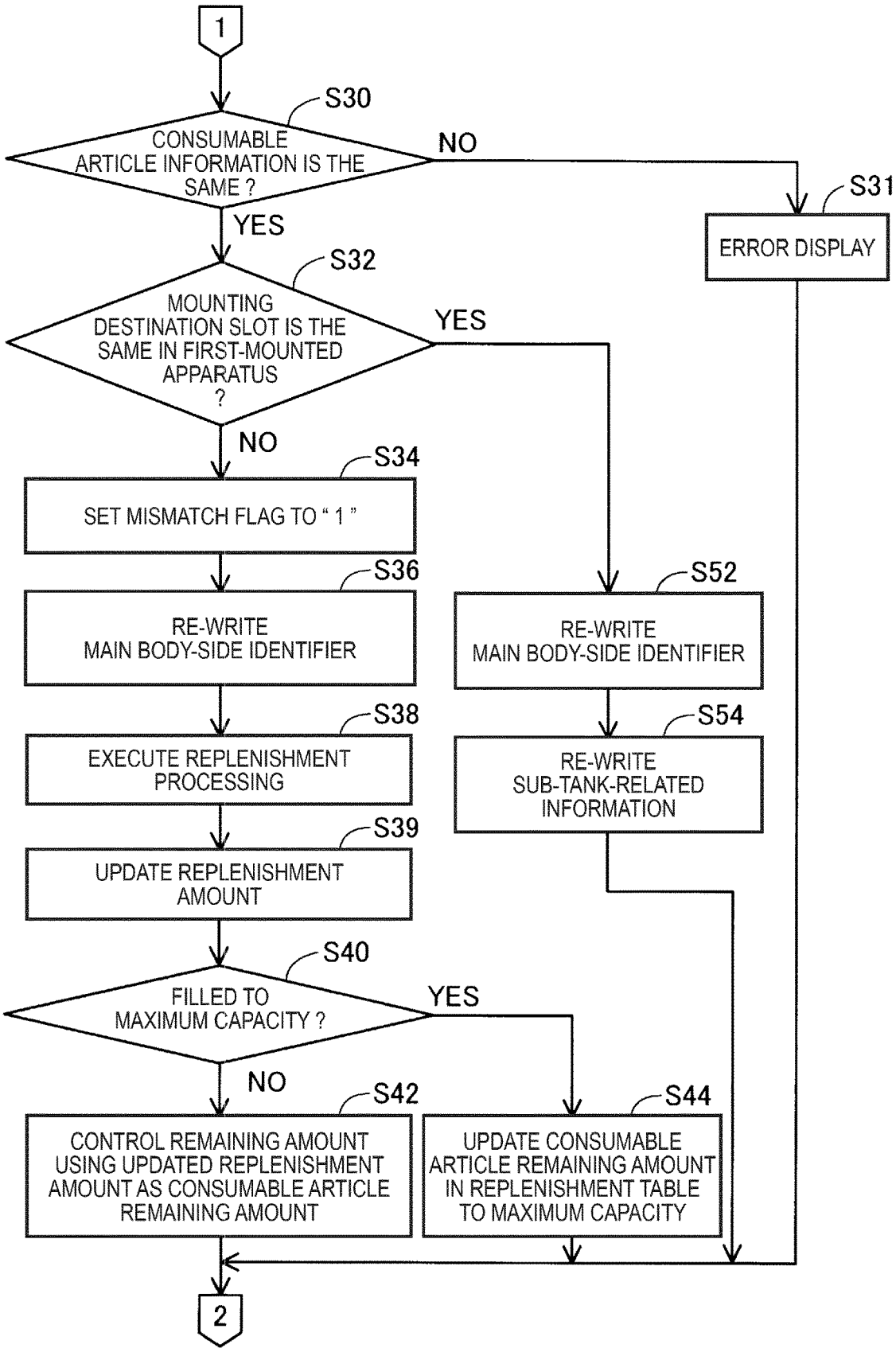
FIG. 12 is a third flowchart for a step of management control of a sub-tank, executed by the operation controller.

As shown in FIG. 12, if the result of the determination is "NO" in step S10, it is determined whether or not the sub-tank-side consumable article information stored in the target sub-tank 40 matches the main body-side consumable article information associated with the slot identifier of the slot 90 that is the mounting destination (step S30). If the sub-tank-side consumable article information and the main body-side consumable article information do not match (step S30: NO), the attribute (in the present embodiment, the color) of the consumable article handled by the slot 90 that is the mounting destination and the attribute of the consumable article contained in the target sub-tank 40 are different. Accordingly, in this case, the operation controller 322 displays an error on the display unit 34 in order to prompt the user to remove the target sub-tank 40 from the slot 90 that is the mounting destination (step S31).

On the other hand, if the sub-tank-side consumable article information and the main body-side consumable article information match (step S30: YES), the attribute (in the present embodiment, color) of the consumable article handled by the slot 90 that is the mounting destination and the attribute of the consumable article contained in the target sub-tank 40 are the same, and therefore the target sub-tank 40 can continue to be used. Accordingly, in this case, the operation controller 322 determines whether or not the slot 90 that is the mounting destination is the slot 90 that is included in the consumable article consumption apparatus 30 in which the target sub-tank 40 was first mounted (step S32). This determination is performed based on whether or not one of the main body-side identifiers stored in the identifier table 332 (FIG. 4) and the sub-tank-side identifier stored in the sub-tank-side storage unit 420 (FIG. 9) of the target sub-tank 40 match. If one of the main body-side identifiers and the sub-tank-side identifier match, the result of the determination is "YES" in step S32. One example in which the result of the determination is "YES" in step S32 is a case (switched mounting case) in which, in FIG. 1, the sub-tank 40C1 is removed from the slot 90C1, the sub-tank 40C2 is removed from the slot 90C2, the sub-tank 40C1 is mounted in the slot 90C2, and the sub-tank 40C2 is mounted in the slot 90C1.

If the result of the determination is "YES" in step S32, in the identifier table 332, the operation controller 322 re-writes the main body-side identifier stored in association with the slot identifier of the slot 90 that is the mounting destination to the sub-tank-side identifier of the target sub-tank 40 (step S52). For example, in the above-described switched mounting case, in the identifier table 332 shown in FIG. 4, as indicated by the arrow, the main body-side identifier stored in association with the slot identifier SC1*a* is re-written from "TA11" to "TA12", and the main body-side identifier stored in association with the slot identifier SC2*a* is re-written from "TA12" to "TA11".

If the result of the determination is "YES" in step S32, in the replenishment table 334, the operation controller 322 re-writes the sub-tank-side information stored in association with the slot identifier of the slot 90 that is the mounting destination, in response to the re-writing of the sub-tank-side identifier of the mounted sub-tank 40 (step S54). For example, in the above-described switched mounting case, in the replenishment table 334 shown in FIG. 5, as indicated by the arrows, the sub-tank-related information stored in association with the slot identifier SC1*a* and the sub-tank-related information stored in association with the slot identifier SC2*a* are exchanged. Accordingly, it is possible to correctly perform the remaining amount control and replacement time determination for the sub-tanks 40 that were subjected to exchange mounting, while reducing the likelihood that the handling of the sub-tanks 40 will be complicated for the user.

If the result of the determination is "NO" in step S32, this means that a sub-tank 40 that was first mounted on another consumable article consumption apparatus 30 was mounted in a slot 90 of the consumable article consumption apparatus 30 executing the present flow (other apparatus mounting state). Accordingly, the operation controller 322 of the consumable article consumption apparatus 30 sets the mismatch flag stored in the sub-tank-side storage unit 420 of the mounted sub-tank 40 to "1" (step S34). Next, in the identifier table 332, the operation controller 322 re-writes the main body-side identifier stored in association with the slot identifier of the slot 90 that is the mounting destination to the sub-tank-side identifier of the target sub-tank 40 (step S36).

In the case of the other apparatus mounting state, the consumable article consumption apparatus 30 executing the current flow cannot determine the actual consumable article remaining amount of the mounted sub-tank 40. Accordingly, the consumable article consumption apparatus 30 executes replenishment processing on the mounted sub-tank 40 (step S38). Next, the operation controller 322 updates the replenishment amount (FIG. 5) associated in the replenishment table 334 with the slot identifier of the slot in which the target sub-tank 40 is mounted, to the replenishment amount obtained by performing replenishing in step S38 (step S39). Next, the operation controller 322 determines whether or not the target sub-tank 40 has been filled to the maximum capacity (900 ml in the present embodiment) (step S40). Step S40 has the same processing content as step S26 in FIG. 11.

If the result of the determination is "NO" in step S40, the operation controller 322 performs remaining amount control using the replenishment amount updated in step S39 as the consumable article remaining amount of the target sub-tank 40 (step S42). Specifically, for example, if the target sub-tank 40 storing the identification information (a mismatch flag of "1") is switched to a supply-side sub-tank 40B, supply of the consumable article to the discharge portion 60 is stopped before the supply amount of the consumable article supplied by the target sub-tank 40 to the discharge portion becomes greater than or equal to the replenishment amount of the consumable article replenished from the main tank 20 in step S38. Accordingly, it is possible to reduce the likelihood that the consumable article in the target sub-tank 40 will run out.

If the result of the determination is "YES" in step S40, the operation controller 322 updates the consumable article remaining amount stored in the replenishment table 334 for the slot identifier associated with the same main body-side identifier as the sub-tank-side identifier of the target sub-tank 40 to the maximum capacity (step S44). The operation controller 322 performs remaining amount control for the target sub-tank 40 based on the consumable article remaining amount that was updated in step S44. For example, the operation controller 322 stops supplying the consumable article from the target sub-tank 40 to the discharge portion 60 before the updated consumable article remaining amount reaches zero.

According to the above-described first embodiment, the sub-tank 40 includes a case 42 (FIG. 1) that can be detachably attached to the multiple slots 90, and if the consumable article is replenished from the main tank 20, the sub-tank-side storage unit 420 stores the sub-tank-side consumable article information (step S8 in FIG. 10). Accordingly, in the state prior to first being mounted in the slot 90, the sub-tank 40 can be used in common in multiple slots, and therefore the stocks of the sub-tanks 40 do not need to be managed for each slot 90. Also, due to the sub-tank 40 including a case 42 (see FIG. 1) that can be detachably attached to the multiple slots 90, it is possible to reduce the manufacturing cost of the sub-tank 40 compared to the case of manufacturing a case 42 with a non-interchangeable shape for each slot 90. Also, according to the above-described first embodiment, the sub-tank-side storage unit 420 stores the sub-tank-side identifier, and therefore it is possible to easily make a distinction from another sub-tank, even after the consumable article has been replenished in the consumable article containing portion 44.

Also, when the sub-tank 40 is mounted in a slot 90 of another consumable article consumption apparatus 30 that is different from the consumable article consumption apparatus 30 in which the sub-tank 40 was first mounted, the sub-tank-side storage unit 420 of the sub-tank 40 stores the mismatch flag "1" as the identification information. Accordingly, the operation controller 322 of the consumable article consumption apparatus 30 can determine whether or not the sub-tank 40 was mounted in a slot 90 of another consumable article consumption apparatus 30 according to the identification information.

According to the above-described first embodiment, when an unused sub-tank 40 is first mounted on one of the multiple slots 90, the controller 32 reads out the sub-tank-side identifier and the operation controller 322 stores it in the main body-side storage unit 331 as the main body-side identifier in association with the slot 90 that is the mounting destination. Accordingly, the operation controller 322 can easily determine whether or not a certain sub-tank 40 has been mounted in a certain slot 90 in the past by comparing the main body-side identifier and the sub-tank-side identifier.

According to the above-described first embodiment, when the target sub-tank 40 in which the sub-tank-side consumable article information is stored in the sub-tank-side storage unit 420 is mounted in a slot 90, if the following condition (identification information condition) is satisfied, the operation controller 322 sets the mismatch flag "1" in the sub-tank-side storage unit 420 of the target sub-tank 40 as the identification information (step S32: NO, step S34 in FIG. 12). Accordingly, the operation controller 322 can easily determine that the target sub-tank 40 was mounted in the slot 90 of another consumable article consumption apparatus 30.

Identification Information Condition

The main body-side identifier associated with the slot 90 that is the mounting destination and the sub-tank-side identifier stored in the sub-tank-side storage unit 420 are different from each other, and the sub-tank-side identifier is different from all of the multiple main body-side identifiers associated with the multiple slots.

According to the above-described first embodiment, the identification information is represented by a flag (mismatch flag). Accordingly, it is possible to easily determine whether or not the sub-tank 40 was mounted in a slot 90 of another consumable article consumption apparatus 30 using the flag.

According to the above-described first embodiment, when the target sub-tank 40 is mounted in a slot 90, if the identification information is stored in the sub-tank-side storage unit 420 of the target sub-tank 40, the operation controller 322 replenishes the consumable article in the target sub-tank 40 from the main tank 20 (step S22 in FIG. 11, step S38 in FIG. 12). Accordingly, it is possible to replenish the consumable article in the target sub-tank 40 before the consumable article in the target sub-tank 40 is consumed. Thus, it is possible to reduce the likelihood that the consumable article in the target sub-tank 40 will run out.

According to the above-described first embodiment, when a target sub-tank 40 having a sub-tank-side storage unit 420 in which the sub-tank-side consumable article information is stored is mounted in a slot 90, if the following condition (re-writing condition) is satisfied, the operation controller 322 performs the following re-writing operation (step S32: YES, step S52, and step S54 in FIG. 12). Accordingly, it is possible to reduce the likelihood that the handling of the sub-tanks 40 will be complicated for the user.

Re-Writing Condition

The main body-side identifier associated with the slot 90 that is the mounting destination and the sub-tank-side identifier stored in the sub-tank-side storage unit 420 are different from each other, and the sub-tank 40 is mounted in another slot 90 associated with main body-side consumable article information that is the same as the sub-tank-side consumable article information, among multiple slots 90 included in the same consumable article consumption apparatus 30.

Re-Writing Operation

The main body-side identifier associated with the slot 90 that is the mounting destination is re-written to the sub-tank-side identifier of the mounted sub-tank 40, and the sub-tank-related information (FIG. 5) associated with the slot 90 that is the mounting destination is re-written in response to the re-writing of the sub-tank-side identifier of the mounted sub-tank 40.

Also, if the re-writing condition is satisfied, the operation controller 322 re-writes the main body-side identifier and the sub-tank-related information without setting the mismatch flag to "1". Accordingly, replenishment processing is not executed on the sub-tank 40 due to the mismatch flag being set to "1". Thus, it is possible to suppress a case in which the interior of the case 42 enters the pressure increase state or the pressure reduction state more than a necessary number of times, and therefore the lifespan of the sub-tank 40 can be prevented from being shortened.

B. Second Embodiment

In the above-described first embodiment, the operation controller 322 distinguishes that the mismatch flag has been set to "1" in the sub-tank-side storage unit 420, and thus determines that the sub-tank 40 was mounted in the slot 90 of another consumable article consumption apparatus 30. However, the operation controller 322 may use other information to determine that the sub-tank 40 was mounted in the slot 90 of another consumable article consumption apparatus 30. Hereinafter a specific example thereof will be described.

FIG. 13 is a diagram for illustrating a sub-tank-side storage unit 420*a* of the second embodiment. The difference from the sub-tank-side storage unit 420 (FIG. 9) of the above-described first embodiment is that a sub-tank-side pressure increase instance count region 444*a* and a sub-tank-side pressure reduction instance count region 444*b* are included instead of the mismatch flag 444. Since the other configurations are similar to those of the first embodiment, the other configurations are denoted by the same reference signs, and description thereof is omitted.

The sub-tank-side pressure increase instance count region 444*a* is a region in which the number of instances that the interior of the case 42 enters the pressure increase state during the replenishment processing is stored. The operation controller 322 adds 1 to the number of instances of the pressure increase state stored in the sub-tank-side pressure increase instance count region 444*a* each time the replenishment processing is executed on the target sub-tank 40 and the interior of the case 42 reaches the pressure increase state. The sub-tank-side pressure reduction instance count region 444*b* is a region in which the number of instances that the interior of the case 42 enters the pressure reduction state during the replenishment processing is stored. The operation controller 322 adds 1 to the number of instances of the pressure increase state stored in the sub-tank-side pressure reduction instance count region 444*b* each time the replenishment processing is executed on the target sub-tank 40 and the interior of the case 42 reaches the pressure reduction state.

Here, if the sub-tank 40 is correctly attached to and detached from one slot 90 (e.g., slot identifier SC1*a*) in which the sub-tank 40 was first mounted (the case of a correct attachment/detachment state), the number of instances (e.g., 1) of the pressure reduction state stored in the replenishment table 334 (FIG. 5) and the number of instances (e.g., 1) of the pressure reduction state stored in the sub-tank-side pressure reduction instance count region 444*b* match. Also, in the case of the correct mounting state, the number of instances (e.g., 1) of the pressure increase state stored in the replenishment table 334 and the number of instances (e.g., 1) of the pressure increase state stored in the sub-tank-side pressure increase instance count region 444*a* match. On the other hand, if the target sub-tank 40 was mounted in a slot 90 of another consumable article consumption apparatus 30 that is different from the one slot 90 in which the sub-tank 40 was first mounted (a case of an other apparatus mounting state), there is a high likelihood that the number of instances of the pressure increase state and the number of instances of the pressure reduction state of the replenishment table 334 managed by the consumable article consumption apparatus 30 and the number of instances of the pressure increase state and the number of instances of the pressure reduction state stored in the sub-tank-side storage unit 420*a* of the target sub-tank 40 will not match.

Accordingly, when the sub-tank 40 that stores the sub-tank-side consumable article information in the sub-tank-side storage unit 420*a* is mounted in the slot 90, if at least one of the following two conditions (mismatch conditions) is satisfied, the operation controller 322 replenishes the consumable article from the main tank 20 to the mounted sub-tank 40 (executes replenishment processing). That is, in the second embodiment, the operation controller 322 determines the other apparatus mounting state using the number of instances of the pressure reduction state and the number of instances of the pressure increase state, instead of the identification information. The number of instances of the pressure reduction state and the number of instances of the pressure increase state correspond to "information configured to identify that the sub-tank was mounted in the slot (90) of another consumable article consumption apparatus" described in the solution to the problem.

First Mismatch Condition

The number of instances of the pressure reduction state stored in association with the slot 90 and the number of instances of the pressure reduction state stored in the sub-tank-side storage unit 420*a* of the target sub-tank 40 do not match.

Second Mismatch Condition

The number of instances of the pressure increase state stored in association with the slot 90 and the number of instances of the pressure increase state stored in the sub-tank-side storage unit 420*a* of the target sub-tank 40 do not match.

Also, the consumable article consumption system of the second embodiment determines whether or not at least one of the first mismatch condition and the second mismatch condition is satisfied, instead of determining whether or not the mismatch flag executed by the consumable article consumption system 10 of the first embodiment is "1" (step S12 of FIG. 11). Also, the consumable article consumption system of the second embodiment can omit the processing for keeping the mismatch flag at "1" (part of step S27 in FIG. 11), setting the mismatch flag to "0" (part of step S28 in FIG. 11), and setting the mismatch flag to "1" (step S34 in FIG. 12), which are shown in FIGS. 11 and 12.

According to the above-described second embodiment, a similar effect is demonstrated due to the second embodiment having a configuration similar to that of the first embodiment. Also, according to the second embodiment, the replenishment processing to the sub-tank 40 is executed when in the other apparatus mounting state, and thereby the consumable article can be replenished in the sub-tank 40 before the consumable article in the sub-tank 40 is consumed. Accordingly, it is possible to reduce the likelihood that the consumable article in the sub-tank will run out.

Also, the operation controller 322 stops the supply of the consumable article to the discharge portion 60 before the supply amount of the consumable article supplied to the discharge portion 60 reaches the replenishment amount of the consumable article or more in the sub-tank 40 in which the consumable article was replenished when at least one of the first mismatch condition and the second mismatch condition was satisfied. Accordingly, it is possible to further reduce the likelihood that the consumable article in the sub-tank 40 will run out.

C. Other Embodiments

Note that the invention is not limited to the above-described embodiment, and can be implemented in various modes without departing from the spirit thereof. For example, the following other embodiments can be implemented.

C-1. First Other Embodiment

In the above-described first and second embodiments, when in the other apparatus mounting state (e.g., when the mismatch flag is set to "1" in the first embodiment), the replenishment amount (actual replenishment step) in the replenishment processing executed by the operation controller 322 may be controlled as follows.

The operation controller 322 estimates the amount of time (other apparatus mounting time) for which the sub-tank 40 was mounted in the other consumable article consumption apparatus 30 and estimates the maximum amount (estimated consumable article consumption amount) of the consumable article in the sub-tank 40 that can be consumed by the other consumable article consumption apparatus 30 in the estimated amount of time. The other apparatus mounting time is an amount of time for which the sub-tank 40 storing the sub-tank-side identifier that is the same as the main body-side identifier is removed. The estimated consumable article consumption amount can be estimated by multiplying the maximum supply rate (in the present embodiment, 20 ml/min) by the amount of time for which the sub-tank 40 was removed. Accordingly, the consumable article can be replenished in the sub-tank 40 by the estimated consumable article consumption amount of the consumable article consumed by the other consumable article consumption apparatus 30, and therefore it is possible to reduce the likelihood that the consumable article of the sub-tank 40 will run out.

Also, if the consumable article remaining amount associated with the slot identifier is less than or equal to a predetermined threshold (e.g., 300 ml) the consumable article may be replenished by the estimated consumable article consumption amount in the sub-tank 40. By doing so, it is possible to reduce the number of instances of executing the replenishment processing while reducing the likelihood that the consumable article in the sub-tank 40 will run out, and therefore it is possible to reduce the likelihood that the lifespan of the sub-tank 40 will be shortened.

C-2. Second Other Embodiment

FIG. 14 is a diagram showing a condition for a stirring instruction that is given to the user and is executed by the operation controller 322. The determination of the stirring instruction to the user may be performed according to the condition shown in FIG. 14. For example, the stirring instruction is performed through a message saying "Please remove and stir the sub-tank 40 mounted in the slot 90C1" on the display unit 34. If the amount of time that has elapsed since the previous instance of replenishment processing is less than three weeks, the operation controller 322 does not perform the stirring instruction, regardless of the replenishment amount of the consumable article in the previous instance. Also, when the amount of time that has elapsed since the previous instance of replenishment processing is three weeks or more and less than six weeks, and if the replenishment amount of the consumable article of the previous instance is less than 600 ml, the operation controller 322 displays the stirring instruction on the display unit 34. Also, if the amount of time that has elapsed since the previous instance of replenishment processing is less than six weeks, the operation controller 322 displays the stirring instruction on the display unit 34, regardless of the replenishment amount of the consumable article in the previous instance. In this manner, the operation controller 322 determines whether or not to give the stirring instruction to the user based on the amount of time that has elapsed since the previous instance of replenishment processing and the replenishment amount of the consumable article in the previous instance, and thus the operation controller 322 can give the stirring instruction to the user if there is a high likelihood that there is a deviation in the concentration distribution of the consumable article in the consumable article containing portion 44.

Also, in a case where there is a sub-tank 40 (stirring target sub-tank 40) for which the stirring instruction is to be given, as in FIG. 14, if the other sub-tank 40 satisfies the following condition (other sub-tank stirring condition), the operation controller 322 may give the stirring instruction for the other sub-tank 40 as well as for the stirring target sub-tank 40.

Other Sub-Tank Stirring Condition (i) The replenishment amount of the consumable article of the previous instance is less than 600 ml and the amount of time that has elapsed since the previous instance of the replenishment processing is less than two weeks, and (ii) the consumption amount of the consumable article after the previous instance of the replenishment processing is less than 600 ml.

Also, the stirring instruction given by the operation controller 322 may be given at a time of static pressure (a time at which the replenishment pump 52 and the supply pump 54 are not running) instead of at a time when the pressure in the case 42 of the sub-tank 40 is being increased or reduced. By doing so, it is possible to reduce the likelihood that the sub-tank 40 will be removed from the slot 90 during execution of the switching preparation step.

C-3. Third Other Embodiment

In the above-described embodiments, the sub-tanks 40 contain ink (liquid) serving as a consumable article, and the discharge portion 60 ejects the ink, but the consumable article may be an article other than ink. For example, the consumable article may be toner, used paper to be used to recycle paper, or a resin raw material to be used in a 3D printer. Also, the consumable article information is ink color, but there is no limitation to this. For example, the consumable article information may be another attribute, such as the viscosity or the raw materials of the consumable article.

C-4. Fourth Other Embodiment

The invention is not limited to an inkjet printer and a sub-tank and main tank for supplying ink to the inkjet printer, and can also be applied to any consumable article consumption apparatus that ejects a consumable article other than ink, and a sub-tank and main tank for containing the consumable article. For example, the invention can be applied to the following various consumable article consumption apparatuses and sub-tanks thereof.

(1) An image recording apparatus such as a facsimile apparatus (2) A color material ejection apparatus used to manufacture a color filter for use in an image display apparatus such as a liquid crystal display (3) An electrode material ejection apparatus used to form electrodes of an organic EL (electro luminescence) display, a field emission display (FED), or the like (4) A consumable article consumption apparatus that ejects a liquid including biological organic matter to be used in biochip manufacture (5) A sample ejection apparatus serving as a precision pipette (6) An ejection apparatus for a lubricant (7) An ejection apparatus for a resin liquid (8) A consumable article consumption apparatus that ejects a lubricant by pinpoint to a precision machine such as a clock or a camera (9) A consumable article consumption apparatus that ejects, onto a substrate, a clear resin liquid such as an ultraviolet curable resin in order to form a minute hemispherical lens (optical lens) or the like to be used in an optical communication terminal or the like

(10) A consumable article consumption apparatus that ejects an acidic or alkaline etching liquid in order to etch a substrate or the like

(11) A consumable article consumption apparatus that includes a consumable article consuming head that discharges any other minute droplets Note that "droplet" refers to a state of the liquid discharged from consumable article consumption apparatuses, and includes droplets having a granular shape, a tear-drop shape, and a shape with a thread-like trailing end. The "liquid" mentioned here need only be a material that can be ejected by consumable article consumption apparatuses. For example, the "liquid" need only be a material in a state where a substance is in a liquid phase, and liquid materials having a high or low viscosity, sols, gel water, and other liquid materials such as inorganic solvents, organic solvents, solutions, liquid resins, and liquid metals (metallic melts) are also included as "liquid". Furthermore, the "liquid" is not limited to being a single-state substance, and also includes particles of a functional material made from solid matter, such as pigment or metal particles, that are dissolved, dispersed, or mixed in a solvent, or the like. Representative examples of the liquid include ink such as that described in the above embodiment, liquid crystal, or the like. Here, "ink" encompasses general water-based ink and oil-based ink, as well as various types of liquid compositions such as gel ink and hot melt ink.

The invention is not limited to the above embodiments, working examples, and modifications, and can be achieved by various configurations without departing from the gist thereof. For example, the technical features in the embodiments, working examples, and modifications that correspond to the technical features in the modes described in the summary of the invention can be replaced or combined as appropriate in order to solve some or all of the problems described above, or in order to achieve some or all of the above-described effects. Technical features that are not described as essential in the specification can be deleted as appropriate.

This application claims the benefit of foreign priority to Japanese Patent Application No. JP2017-199113, filed Oct. 13, 2017, which is incorporated by reference in its entirety.

What is claimed is:

1. A consumable article consumption system comprising:

a consumable article consumption apparatus having a discharge portion for discharging a consumable article, a plurality of slots, and a controller;

a sub-tank having a case that can be detachably attached to the plurality of slots; and a main tank for containing the consumable article to be replenished in the sub-tank mounted in the slot, wherein the consumable article consumption apparatus further includes a main body-side storage unit for storing main body-side consumable article information relating to a type of the consumable article associated with each of the plurality of slots, the sub-tank further includes:

a consumable article containing portion that is contained in the case and is configured to contain the consumable article to be supplied to the discharge portion due to the consumable article being replenished from a main tank containing the consumable article; and a sub-tank-side storage unit that does not store the main body-side consumable article information as a sub-tank-side consumable article information before the sub-tank is first mounted in one of the plurality of slots, and when the sub-tank is first mounted in one of the plurality of slots, the controller stores the main body-side consumable article information associated with the slot in which the sub-tank is mounted, in the sub-tank-side storage unit as the sub-tank-side consumable article information.

2. The consumable article consumption system according to claim 1, wherein the sub-tank-side storage unit stores a sub-tank-side identifier configured to distinguish from another sub-tank.

3. The consumable article consumption system according to claim 2, wherein when the sub-tank is first mounted in the slot, the controller reads out the sub-tank-side identifier from the sub-tank-side storage unit and stores the sub-tank-side identifier in association with the slot that is the mounting destination as a main body-side identifier in the main body-side storage unit.

4. The consumable article consumption system according to claim 3, wherein when the sub-tank with the sub-tank-side storage unit in which the sub-tank-side consumable article information is stored is mounted in the slot, if (i) the main body-side identifier associated with the slot that is the mounting destination and the sub-tank-side identifier stored in the sub-tank-side storage unit are different and (ii) the sub-tank-side identifier is different from all of a plurality of the main body-side identifiers associated with each of the plurality of slots, the controller stores, in the sub-tank-side storage unit, identification information configured to identify that the sub-tank was mounted in the slot of another consumable article consumption apparatus.

5. The consumable article consumption system according to claim 4, wherein when the sub-tank is mounted in the slot, if the identification information is stored in the sub-tank-side storage unit of the mounted sub-tank, the controller replenishes the consumable article in the mounted sub-tank from the main tank.

6. The consumable article consumption system according to claim 5, wherein the controller stops the supply of the consumable article to the discharge portion before the supply amount of the consumable article supplied to the discharge portion becomes greater than or equal to the replenishment amount of the consumable article in the sub-tank with the sub-tank-side storage unit in which the identification information is stored.

7. The consumable article consumption system according to claim 4, wherein the identification information is indicated by a flag.

8. The consumable article consumption system according to claim 2, wherein if the consumable article is to be replenished in the sub-tank mounted in the slot from the main tank, the controller sets the interior of the case to a predetermined pressure reduction state, if the consumable article is to be supplied to the discharge portion from the sub-tank mounted in the slot, the controller sets the interior of the case to a predetermined pressure increase state, the controller stores the number of instances of the pressure reduction state and the number of instances of the pressure increase state in the main body-side storage unit in association with the slot, and each time the interior of the case is set to the pressure reduction state and the pressure increase state, the controller adds 1 to each of the number of instances of the pressure reduction state and the number of instances of the pressure increase state in the sub-tank-side storage unit, and when the sub-tank with the sub-tank-side storage unit in which the sub-tank-side consumable article information is stored is mounted in the slot, if at least one of a first mismatch condition and a second mismatch condition is satisfied, the first mismatch condition being that the number of instances of the pressure reduction state stored in association with the slot and the number of instances of the pressure reduction state stored in the sub-tank-side storage unit do not match and the second mismatch condition being that the number of instances of the pressure increase state stored in association with the slot and the number of instances of the pressure increase state stored in the sub-tank-side storage unit do not match, the controller replenishes the consumable article in the mounted sub-tank from the main tank.

9. The consumable article consumption system according to claim 8, wherein if at least one of the first mismatch condition and the second mismatch condition is satisfied, the controller stops supply of the consumable article to the discharge portion before the supply amount of the consumable article supplied to the discharge portion becomes greater than or equal to the replenishment amount of the consumable article in the sub-tank in which the consumable article was replenished.

10. The consumable article consumption system according to claim 3, wherein the main body-side storage unit further stores sub-tank-related information including consumable article remaining amount information of the sub-tank, associated with each of the plurality of slots, and when the sub-tank with the sub-tank-side storage unit in which the sub-tank-side consumable article information is stored is mounted in the slot, if (i) the main body-side identifier associated with the slot that is the mounting destination and the sub-tank-side identifier stored in the sub-tank-side storage unit are different and (ii) the sub-tank is mounted in another slot associated with the main body-side consumable article information that is the same as the sub-tank-side consumable article information among the plurality of slots included in the same consumable article consumption apparatus, the controller re-writes the main body-side identifier associated with the slot that is the mounting destination to the sub-tank-side identifier of the mounted sub-tank, and re-writes the sub-tank-related information associated with the slot that is the mounting destination according to the re-writing of the sub-tank-side identifier of the mounted sub-tank.

* * * * *